US009142926B2

(12) United States Patent
Tsai

(10) Patent No.: US 9,142,926 B2
(45) Date of Patent: Sep. 22, 2015

(54) ELECTRICAL CONNECTOR FOR BIDIRECTIONAL PLUG INSERTION

(76) Inventor: Chou Hsien Tsai, SinJhuang (TW)

( * ) Notice: Subject to any disclaimer, the term of this patent is extended or adjusted under 35 U.S.C. 154(b) by 336 days.

(21) Appl. No.: 12/895,334

(22) Filed: Sep. 30, 2010

(65) Prior Publication Data

US 2012/0015561 A1 Jan. 19, 2012

(30) Foreign Application Priority Data

Jul. 19, 2010 (TW) ..... 99213740 U
Sep. 2, 2010 (TW) ..... 99129807 A

(51) Int. Cl.
*H01R 24/00* (2011.01)
*H01R 27/00* (2006.01)
*H01R 24/60* (2011.01)

(52) U.S. Cl.
CPC ..... *H01R 27/00* (2013.01); *H01R 24/60* (2013.01)

(58) Field of Classification Search
CPC ..... H01R 23/05
USPC ..... 439/660, 676, 218
See application file for complete search history.

(56) References Cited

U.S. PATENT DOCUMENTS 2,745,938 A * 5/1956 Brandler ..... 219/256
3,339,169 A * 8/1967 Freeland ..... 439/55
4,726,786 A * 2/1988 Hill ..... 439/504
5,233,502 A * 8/1993 Beatty et al. ..... 361/679.09
5,270,964 A * 12/1993 Bechtolsheim et al. ..... 365/52
5,289,339 A * 2/1994 Akashi et al. ..... 361/679.31
5,387,110 A * 2/1995 Kantner et al. ..... 439/59
5,404,268 A * 4/1995 O'Connor ..... 361/679.31
5,472,351 A * 12/1995 Greco et al. ..... 439/353
5,540,601 A * 7/1996 Botchek ..... 439/502
5,636,997 A * 6/1997 Kuroda et al. ..... 439/74
5,964,610 A * 10/1999 McCoy ..... 439/218
6,145,037 A * 11/2000 Sakakibara ..... 710/301
6,190,190 B1 * 2/2001 Daly et al. ..... 439/218
6,729,415 B1 * 5/2004 Huang ..... 173/217
6,981,887 B1 * 1/2006 Mese et al. ..... 439/244
7,094,086 B2 * 8/2006 Teicher ..... 439/173
7,094,089 B2 * 8/2006 Andre et al. ..... 439/218
7,144,262 B2 * 12/2006 Cheng ..... 439/151
7,361,059 B2 * 4/2008 Harkabi et al. ..... 439/660
7,404,298 B2 * 7/2008 Kim et al. ..... 62/126
7,537,471 B2 * 5/2009 Teicher ..... 439/172
7,553,172 B2 * 6/2009 Chiu et al. ..... 439/131
7,591,657 B2 * 9/2009 Teicher ..... 439/173
7,682,169 B2 * 3/2010 Park ..... 439/159

(Continued)

*Primary Examiner* — Neil Abrams
(74) *Attorney, Agent, or Firm* — Pro-TECHTOR International Services; Ian B. Oglesby

(57) ABSTRACT

An electrical connector, into which a male plug, having an insulation base, a metal housing covering the base and a connection space therebetween, may be inserted in a bidirectional manner. The connector includes a plastic base, a tongue, a connection slot and two rows of connection points. The tongue is projectingly disposed at a front end of the plastic base. The slot disposed at the front end of the plastic base covers the tongue. When the plug is inserted and positioned within the slot, the tongue is inserted into the connection space. The connection points are exposed from two surfaces of the tongue. Each connection point is electrically connected to a pin extending out of the plastic base. Spaces of the slot beside the two surfaces of the tongue allow the plug to be bidirectionally inserted and positioned. When the plug is positioned within the slot, the metal housing does not touch the connection point to avoid a short circuit as the plug is inserted.

39 Claims, 21 Drawing Sheets

(56) References Cited

U.S. PATENT DOCUMENTS

| | | | | |
|---|---|---|---|---|
| 7,717,717 | B1 * | 5/2010 | Lai | 439/66 |
| 8,170,053 | B2 * | 5/2012 | Chen et al. | 370/463 |
| 8,198,563 | B2 * | 6/2012 | Tsai | 218/140 |
| 8,403,691 | B1 * | 3/2013 | Liang | 439/222 |
| 8,535,075 | B1 * | 9/2013 | Golko et al. | 439/218 |
| 8,596,881 | B2 * | 12/2013 | Umeno | 385/75 |
| 8,647,156 | B2 * | 2/2014 | Golko et al. | 439/668 |
| 8,686,600 | B2 * | 4/2014 | Terlizzi et al. | 307/125 |
| 8,708,745 | B2 * | 4/2014 | Golko et al. | 439/607.41 |
| 8,882,524 | B2 * | 11/2014 | Golko et al. | 439/218 |
| 8,894,296 | B2 * | 11/2014 | Peto | 385/53 |
| 8,911,261 | B2 * | 12/2014 | Liao | 439/660 |
| 8,979,594 | B2 * | 3/2015 | Tsai | 439/660 |
| 2002/0142635 | A1 * | 10/2002 | Pan | 439/101 |
| 2003/0171035 | A1 * | 9/2003 | Yoo | 439/638 |
| 2004/0023560 | A1 * | 2/2004 | Swoboda | 439/638 |
| 2005/0079738 | A1 * | 4/2005 | Ahn | 439/1 |
| 2008/0299833 | A1 * | 12/2008 | Abe | 439/660 |
| 2009/0137155 | A1 * | 5/2009 | Yeh et al. | 439/626 |
| 2010/0279520 | A1 * | 11/2010 | Tsai | 439/62 |
| 2011/0136381 | A1 * | 6/2011 | Cho | 439/620.01 |
| 2012/0015561 | A1 * | 1/2012 | Tsai | 439/660 |
| 2012/0276760 | A1 * | 11/2012 | Cho | 439/77 |
| 2013/0005193 | A1 * | 1/2013 | Tsai | 439/676 |
| 2014/0148063 | A1 * | 5/2014 | Liao | 439/676 |

* cited by examiner

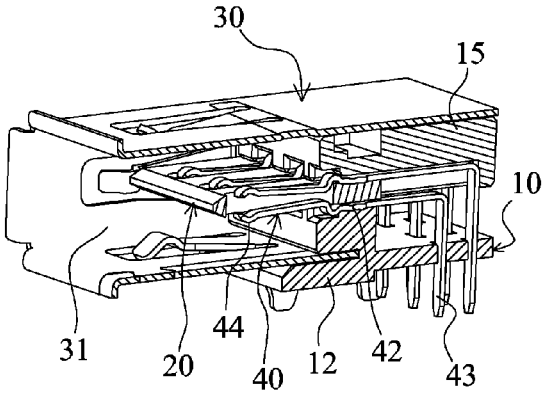
FIG. 20
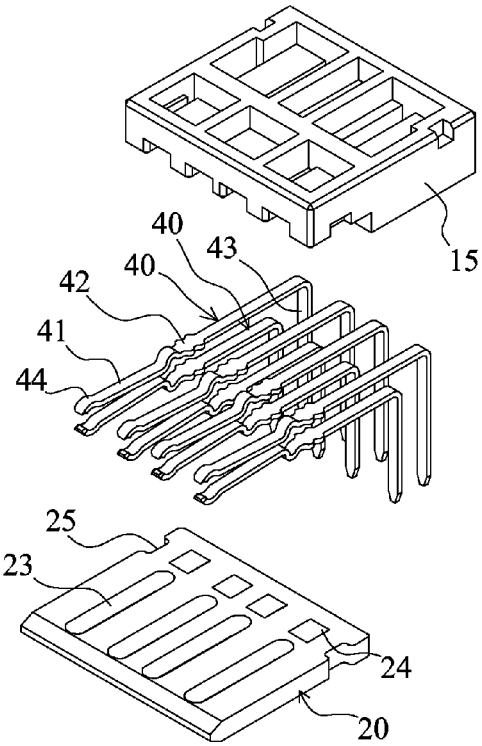
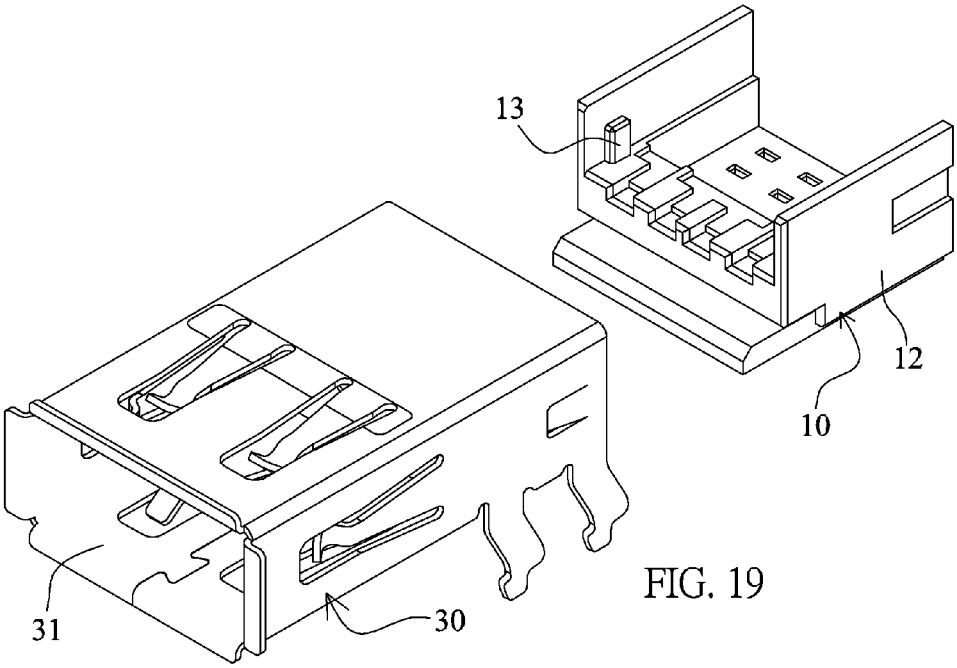
FIG. 19

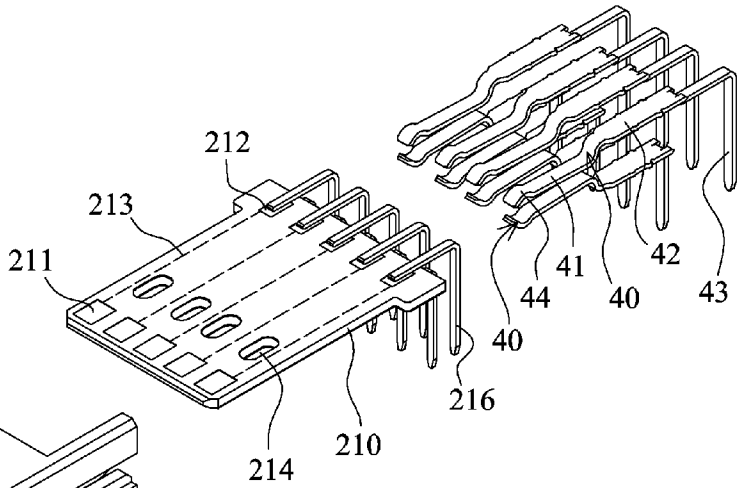
FIG. 22
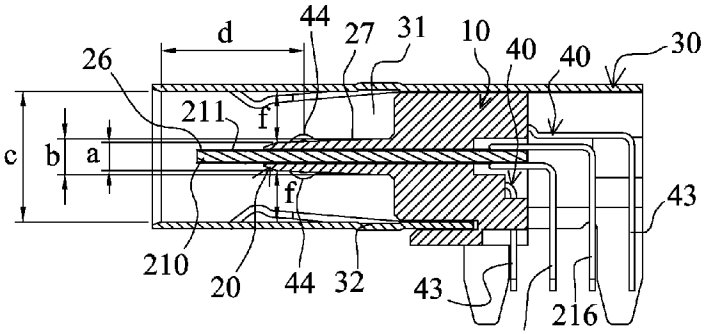
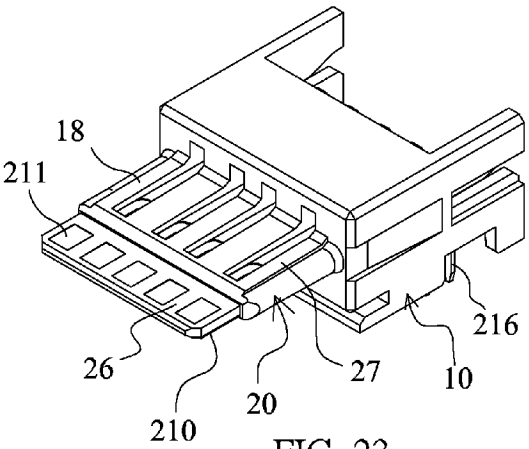
FIG. 23
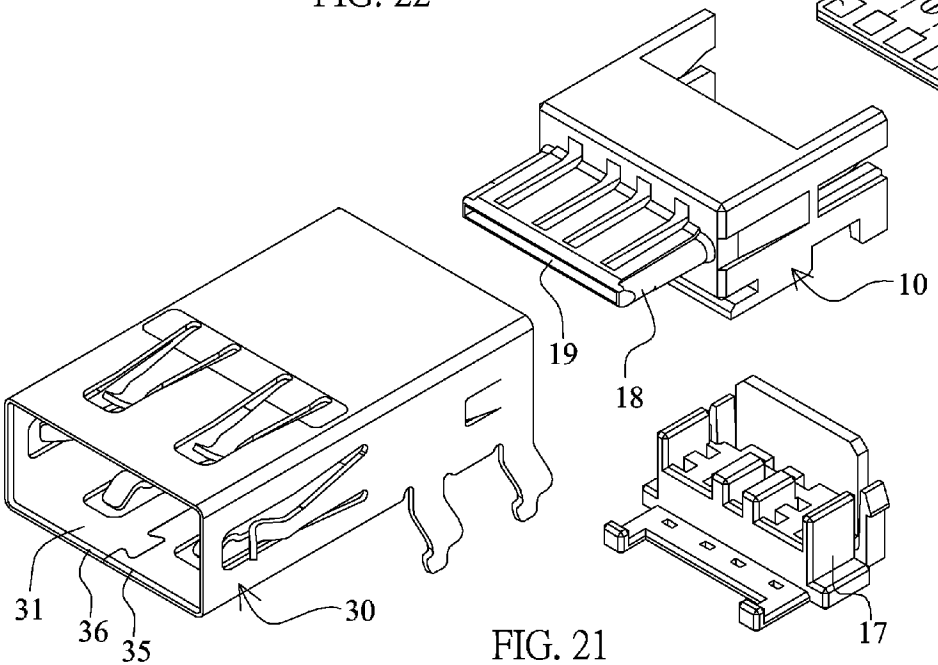
FIG. 21

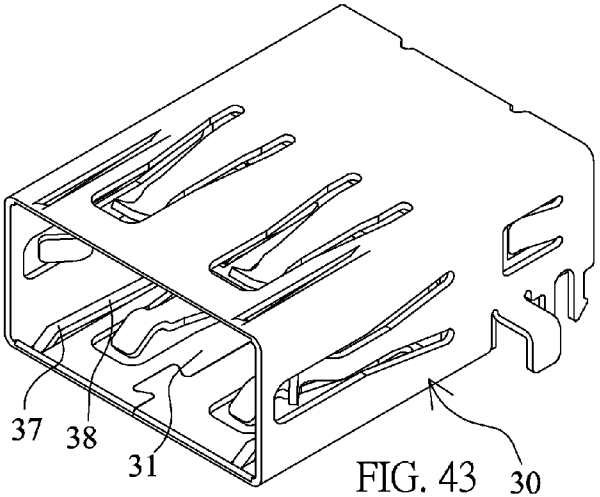
FIG. 43
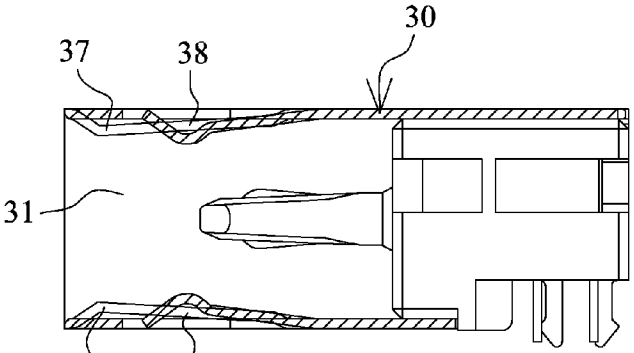
FIG. 44
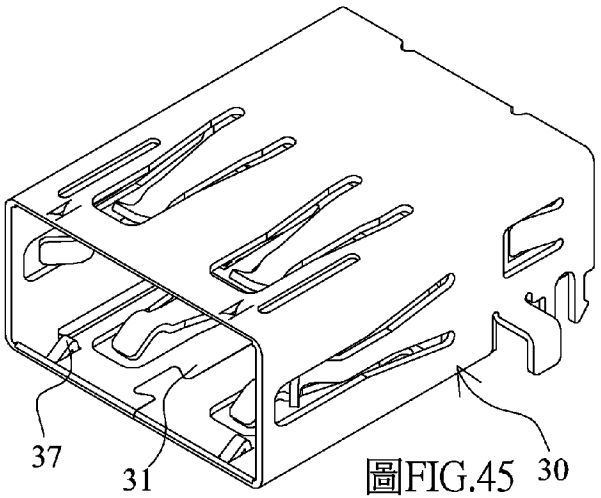
圖FIG.45
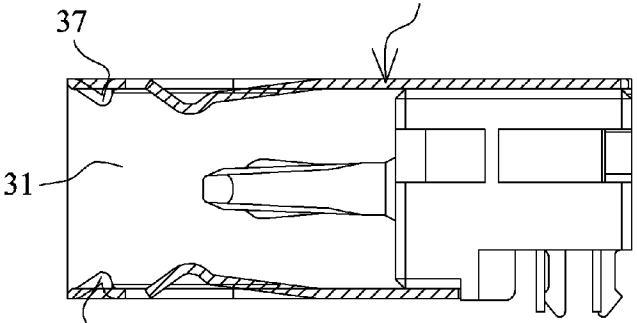
FIG. 46

ELECTRICAL CONNECTOR FOR BIDIRECTIONAL PLUG INSERTION

BACKGROUND OF THE INVENTION

1. Field of the Invention

The invention relates to an electrical connector, and more particularly to an electrical connector for bidirectionally electrical connections.

2. Related Art

The universal serial bus (USB) is the most popular signal transmission specification in the modern computer apparatus. The connector socket and the transmission cable satisfying this specification can make the peripheral apparatus, such as a mouse, a keyboard or the like, which is externally connected to the computer, be immediately plugged and played.

At present, the USB 2.0 and USB 3.0 specifications are used. As shown in FIG. 1, the conventional USB 2.0 male plug 90 includes a plastic base 91 and a metal housing 92. The metal housing 92 covers the plastic base 91, and a connection space 93 is formed between the metal housing 92 and the plastic base 91. Only one surface of the plastic base 91 is formed with one row of connection points 94 exposed to the connection space 93. At present, the specifications specified by the USB Society are listed in the following. The overall height "i" is equal to 4.5 mm, the half height "j" corresponding to the connection space 93 is equal to 2.25 mm, and the height "k" of the connection space is equal to 1.95 mm.

At present, one surface of the tongue of the USB 2.0 socket has one row of connection points. In use, the USB 2.0 plug has to be correctly inserted so that the connection points of the plug and the socket can be aligned and electrically connected together. In order to ensure the electrical connection to be established when the USB plug is inserted, mistake-proof designs, as shown in FIG. 1A, are provided on the socket and the plug. The normal direction corresponds to the mark 97, formed on one surface of the handle 96 connected to the USB 2.0 male plug 90, facing upwards. At this time, the connection point 94 faces upwards. When the plug is inserted in the normal direction, the plug can be electrically connected to the socket. As shown in FIG. 1B, the USB plug cannot be reversely inserted into the socket, so that the electrical connection after the insertion can be ensured. The user usually randomly inserts the plug into the socket, so the possibility of failing to insert the plug is equal to ½. So, the user usually has to insert the plug twice, and the inconvenience in use is caused.

As shown in FIG. 2, the conventional USB 2.0 socket 80 includes a plastic base 81, a metal housing 83 and one row of terminals 87. The front end of the plastic base 81 is integrally formed with a horizontally extending tongue 82. The metal housing 83 is positioned at the front end of the plastic base 81 to form a connection slot 84. The tongue 82 is located at the lower section of the connection slot 84. The one row of four terminals 87 is fixed to the plastic base 81, extends frontwards and is arranged on the tongue 82. A projecting connection point 88 is formed near a distal end of the terminal 87.

In order to match with the mistake-proof design of the male plug, the USB socket 80 has the following dimensions. The height "o" of the connection slot is equal to 5.12 mm; the thickness "p" of the tongue is equal to 1.84 mm; the height "s" above the tongue is equal to 0.72 mm; and the height "q" below the tongue is equal to 2.56 mm. Thus, the USB 2.0 male plug 90 has to be inserted with the connection point 94 facing downwards, so that the connection space 93 and the tongue 82 are fit and positioned with each other. The half height "j" (2.25 mm) is fit with the height "q" (2.56 mm) below the tongue. The reverse USB male plug 90 cannot be inserted. In addition, the horizontal distance "t" from the insert end 86 of the positioning plane of the connection slot 84 to the first connection point 88 of the first terminal is equal to 3.5 mm.

When the USB 2.0 male plug 90 is inserted into the USB socket 80, the plug 90 and the socket 80 are tightly fit with each other according to the height "k" (1.95 mm) of the connection space and the thickness "p" (1.84 mm) of the tongue.

As shown in FIG. 2A, the conventional USB 3.0 socket 85 has the structure and associated dimensions, which are substantially the same as those of the USB 2.0 socket 80 except that the tongue 82 of the USB 3.0 socket 85 is longer and the front section thereof is formed with one row of five second connection points 89, which cannot be elastically moved. In addition, the horizontal distance "t" from the insert end 86 of the positioning plane of the connection slot 84 to the first connection point 88 of the first terminal is equal to 4.07 mm.

The structure and the associated dimensions of the USB 3.0 male plug are substantially the same as those of the USB 2.0 socket 80 except that the USB 3.0 plug additionally has one row of five connection points, which project beyond the connection space and can be elastically moved.

The conventional USB socket, either the USB 2.0 or 3.0 socket only has the contact pattern formed on one single surface, and thus cannot allow the bidirectional insertion and connection. However, if the USB socket is designed to allow the bidirectional insertion and connection, the connection points of the terminals have to be formed on two surfaces of the tongue, the positioning of the bidirectionally inserted USB male plug has to be ensured, and the four terminals 87 cannot be short-circuited. When the USB male plug is inserted and its metal housing touches the connection points 88 of the terminals 87 on one surface of the tongue, the short circuit is caused to damage the USB socket. Due to the above-mentioned problems, the manufacturers have encountered the bottleneck in developing this product.

The applicant has paid attention to the research and development of the bidirectionally inserted and connected USB socket and finally provides the improved structure to overcome the above-mentioned problems and the pattern of the tongue for the USB 3.0 socket.

SUMMARY OF THE INVENTION

It is therefore a main object of the invention to provide an electrical connector, into which a USB plug may be bidirectionally inserted, connected and positioned without being short-circuited.

Another object of the invention is to provide an electrical connector having a tongue tapered from rear to front to enhance the structural strength.

Still another object of the invention is to provide an electrical connector having a connection slot into which a male plug is inserted and slantingly positioned.

Yet still another object of the invention is to provide an electrical connector having a connection slot with an insert port having a reduced height so that the maximum inclined angle for the insertion of the male plug is reduced, the short circuit can be avoided and the insert gap can be reduced to avoid the wobble.

The invention achieves the above-identified objects by providing an electrical connector, into which a male plug may be bidirectionally inserted and connected. The male plug has an insulation base and a metal housing covering the insulation base. A connection space is formed between the metal housing and the insulation base. The electrical connector includes a plastic base, a tongue, a connection slot and two rows of first connection points. The tongue is projectingly disposed at a front end of the plastic base. The connection slot is disposed at the front end of the plastic base and covers the tongue. When the male plug is inserted and positioned within the connection slot, the tongue is inserted into the connection space. The two rows of first connection points are respectively exposed from two surfaces of the tongue. Each of the first connection points is electrically connected to a pin extending out of the plastic base. Spaces of the connection slot beside the two surfaces of the tongue allow the male plug to be bidirectionally inserted and positioned. When the male plug is positioned within the connection slot, the metal housing of the male plug does not touch the first connection point.

The invention further achieves the above-identified objects by providing an electrical connector, into which a male plug may be bidirectionally inserted and connected. The male plug has an insulation base and a metal housing covering the insulation base. A connection space is formed between the metal housing and the insulation base. The electrical connector includes a plastic base, a tongue, a connection slot and two rows of first connection points. The tongue is projectingly disposed at a front end of the plastic base. The connection slot is disposed at the front end of the plastic base and covers the tongue. When the male plug is inserted and positioned within the connection slot, the tongue is inserted into the connection space. The two rows of first connection points are respectively exposed from two surfaces of the tongue, and each of the first connection points is electrically connected to a pin extending out of the plastic base. Spaces of the connection slot beside the two surfaces of the tongue allow the male plug to be bidirectionally inserted and positioned. The connection slot allows the male plug, which is bidirectionally inserted, to be slantingly positioned.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 19 is a pictorially exploded view showing a tenth embodiment of the invention.

FIG. 20 is a pictorially assembled view showing the tenth embodiment of the invention.

FIG. 21 is a pictorially exploded view showing an eleventh embodiment of the invention.

FIG. 22 is a cross-sectional side view showing the eleventh embodiment of the invention.

FIG. 23 is a pictorially assembled view showing a circuit board and a plastic base according to the eleventh embodiment of the invention.

FIG. 43 is a pictorial view showing a 24th embodiment of the invention.

FIG. 44 is a cross-sectional side view showing the 24th embodiment of the invention.

FIG. 45 is a pictorial view showing a 25th embodiment of the invention.

FIG. 46 is a cross-sectional side view showing the 25th embodiment of the invention.

DETAILED DESCRIPTION OF THE INVENTION

The present invention will be apparent from the following detailed description, which proceeds with reference to the accompanying drawings, wherein the same references relate to the same elements.

Figure 3:
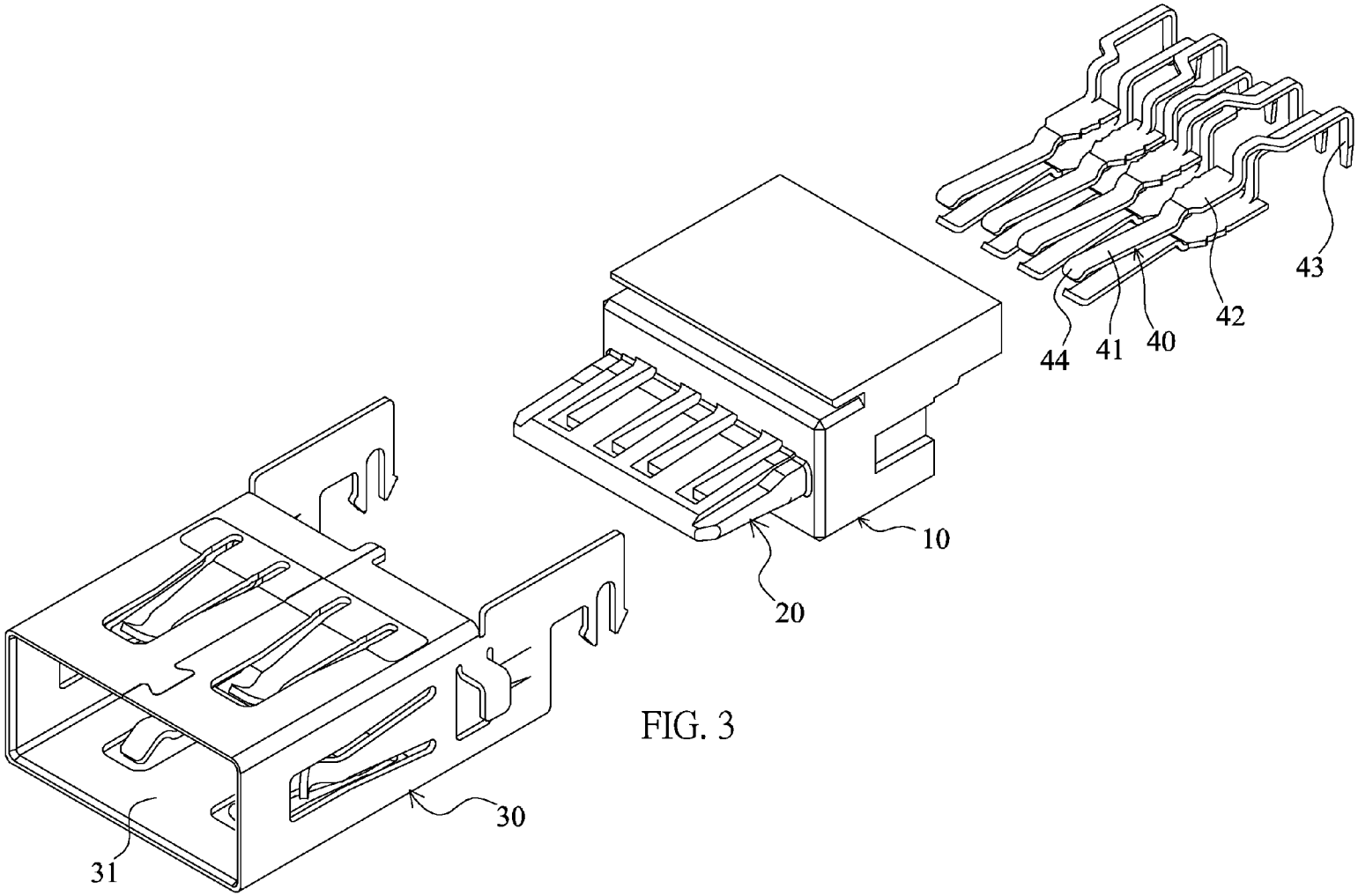
FIG. 3 is a pictorially exploded view showing a first embodiment of the invention.
Figure 4:
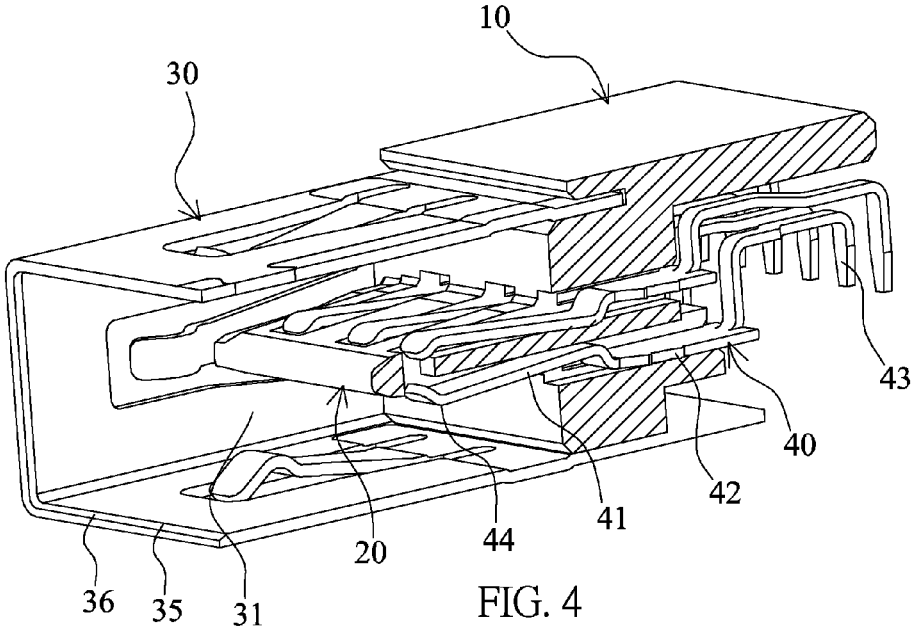
FIG. 4 is a pictorially assembled view showing the first embodiment of the invention.
Figure 5:
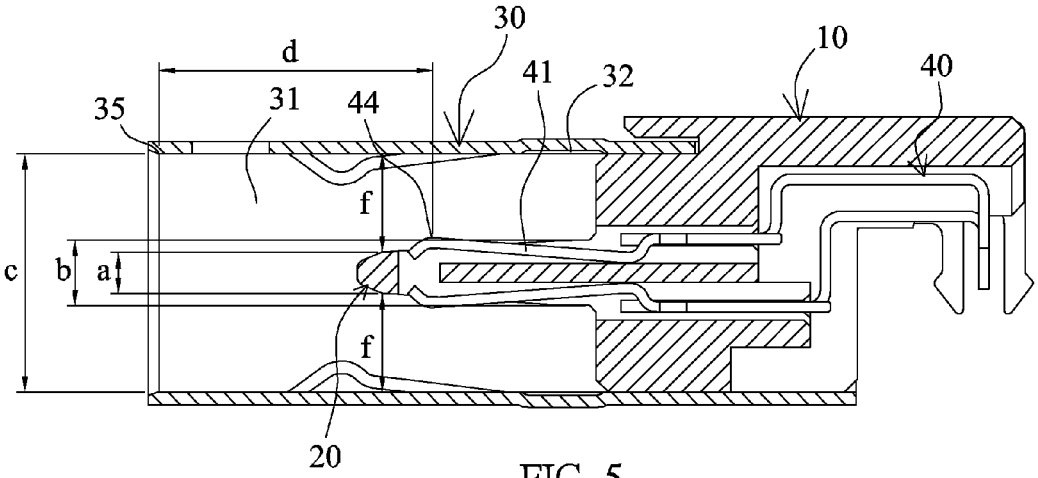
FIG. 5 is a cross-sectional side view showing the first embodiment of the invention.

Referring to FIGS. 3 to 5, the first embodiment of the invention is a USB 2.0 socket, which may be connected to the USB 2.0 male plug 90 and includes a plastic base 10, a tongue 20, a metal casing 30 and two rows of first terminals 40.

The tongue 20 integrally projects beyond the front end of the plastic base 10, and has a thinner front end and a thicker rear end so that it is tapered from rear to front. Thus, the tongue 20 is stronger and cannot be easily broken.

The metal casing 30 is formed with a connection slot 31. The metal casing 30 is disposed at the front end of the plastic base 10 and covers the tongue 20 therein. The top surface and the bottom surface of the rear section of the connection slot 31 are formed with concave surfaces 32, so that the height of the rear section of the connection slot 31 is greater than that of the insert port. The front end of the connection slot 31 is formed with a guide-in inclined surface 36.

Each row of first terminals 40 has four terminals. The first terminal 40 includes an elastic arm 41, a fixing portion 42 and a pin 43. The fixing portion 42 is positioned within the plastic base 10. The elastic arm 41 extends toward the connection slot 31 and is formed with a projecting first connection point 44 projecting beyond one surface of the tongue 20. The first connection points 44 of the two rows of first terminals 40 respectively project beyond two surfaces of the tongue 20.

The invention is characterized in that the spaces of the connection slot 31 on two surfaces of the tongue 20 allow the USB male plug to be bidirectionally inserted and positioned. In addition, when the USB male plug is inserted into the connection slot 31 and reaches a horizontal position of the first connection point 44 of the first terminal 40 with a maximum inclined angle between the USB male plug and the connection slot 31, a gap between the metal housing of the USB male plug and the first connection point is greater than 0.05 mm to prevent the short circuit.

To satisfy the requirements on the bidirectionally electrical connection and the elimination of the short circuit, the length of the metal casing 30 of this embodiment is longer than that of the prior art, the length of the tongue 20 of this embodiment is shorter than that of the prior art, the first connection point 44 shrinks back and the tongue 20 is thinner than that of the prior art. The designed dimensions are listed in the following. The thickness "a" of the front end of the tongue is about 1 mm, the thickness "b" of the rear end of the tongue is about 1.6 mm, the height "c" of the connection slot is about 5.8 mm, the horizontal distance "d" from the insert end 35 of the positioning plane of the connection slot 31 to the first connection point 44 of the first terminal 40 is about 6.6 mm, and the heights "f" of the spaces beside the two surfaces of the tongue range from about 2.3 mm to 2.4 mm. That is, the parameter "f" at the front end of the tongue is equal to (5.8 mm−1 mm)/2=2.4 mm, and is gradually decreased toward the rear end of the tongue. Because the parameter "f" of the rear section of the tongue still has to be greater than 2.3 mm, the concave surface 32 is provided.

The tongue of this embodiment is thinner than that of the prior art, the tongue 20 is configured to be tapered from rear to front in order to enhance the structural strength.

Figure 1:
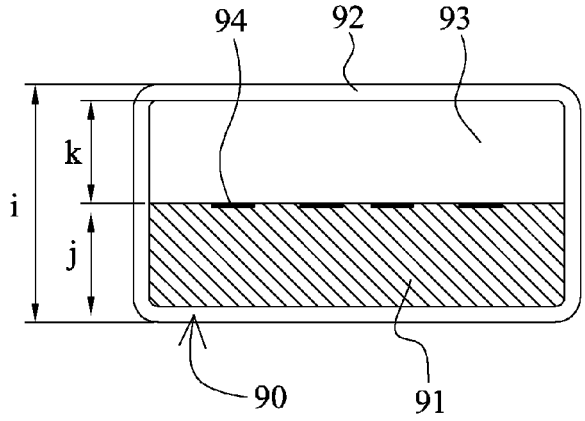
FIG. 1 (Prior Art)
FIG. 1 is a cross-sectional front view showing a conventional USB 2.0 male plug.
Figure 1A:
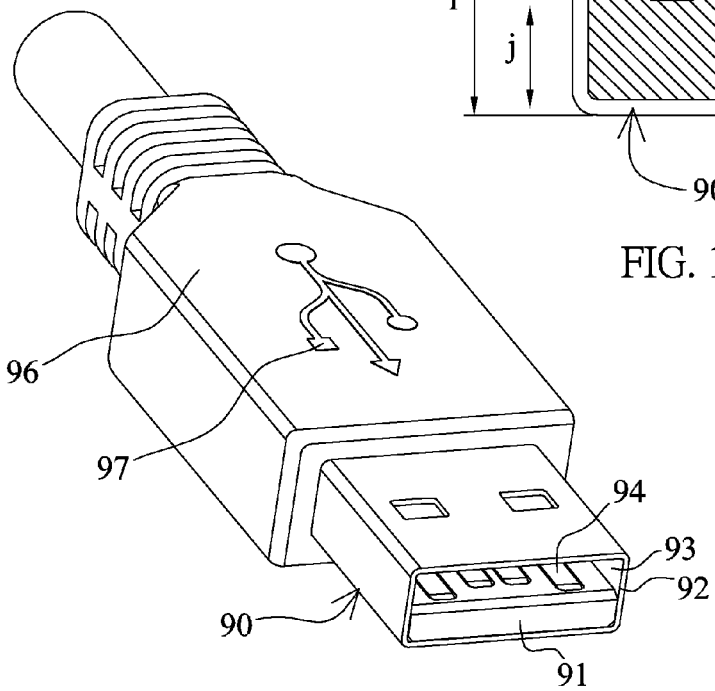
FIG. 1A (Prior Art)
FIG. 1A is a pictorial view showing the conventional USB 2.0 male plug, which is normally inserted and tilts downwards.
Figure 6:
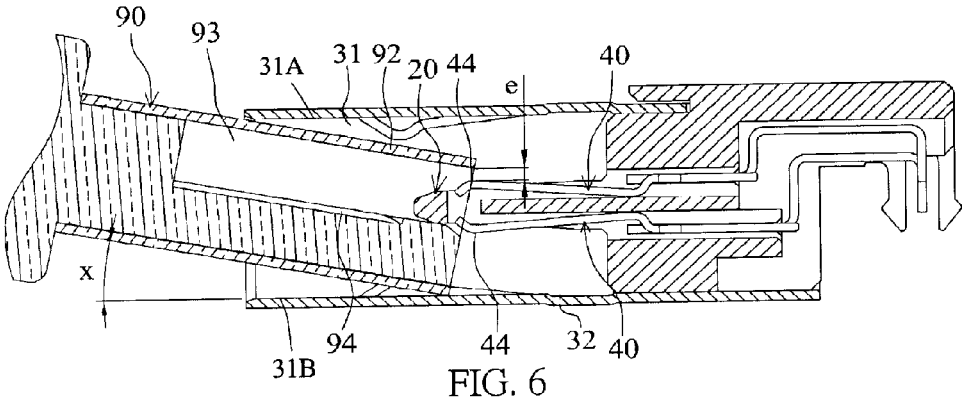
FIG. 6 is a cross-sectional side view showing a usage state of the first embodiment of the invention.
Figure 7:
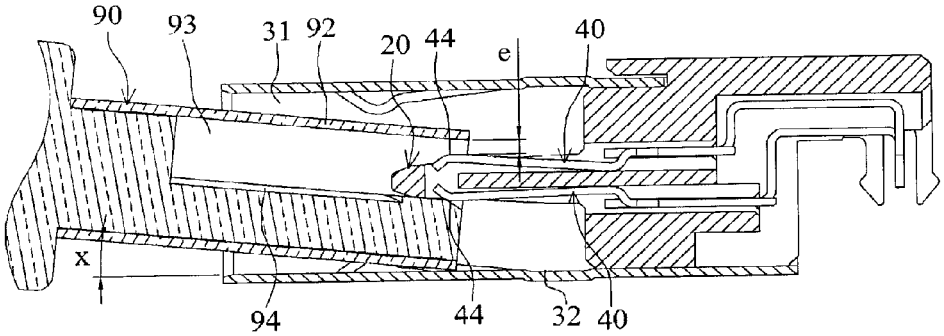
FIG. 7 is a cross-sectional side view showing the usage state of the first embodiment of the invention.
Figure 8:
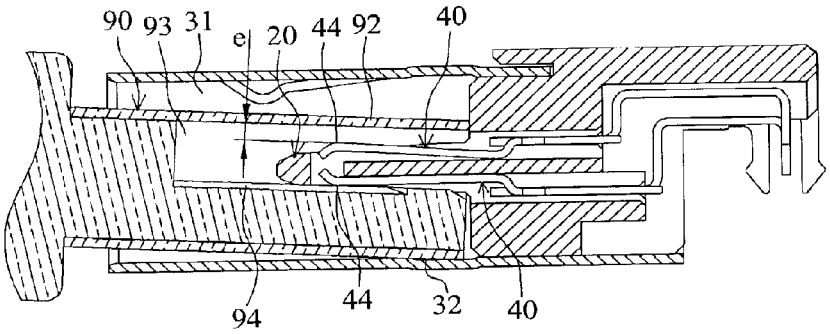
FIG. 8 is a cross-sectional side view showing the usage state of the first embodiment of the invention.

The following operation description illustrates that the metal housing 92 of the USB 2.0 plug 90 cannot touch the first connection point 44 of the first terminal 40 when the USB 2.0 plug 90 is slantingly inserted into the connection slot 31 at any inclined angle. As shown in FIG. 6, the connection point 94 of the USB 2.0 male plug 90 faces upwards and the USB 2.0 male plug 90 is normally inserted into the insert port and tilts downwards (the pictorial view when the USB 2.0 male plug 90 is normally inserted and tilts downwards is illustrated in FIG. 1A). Thus, when the USB 2.0 male plug 90 is inserted into the connection slot 31 and reaches the horizontal position of the first connection point 44 of the first terminal 40 with a maximum inclined angle between the male plug 90 and the connection slot 31, the included angle "x" between the USB 2.0 male plug 90 and the connection slot 31 is about 11.5 degrees, the tongue 20 is accommodated within the connection space 93 of the USB male plug, and the gap "e" between the metal housing 92 and the first connection point 44 on the top surface of the tongue is still greater than 0.3 mm to prevent the short circuit from occurring. At the maximum inclined angle, the male plug 90 is in direct contact with an inner top wall 31A and an inner bottom wall 31B, which define the connection slot 31, and the tongue 20 are partially accommodated within the connection space 93. As shown in FIG. 7, when the USB 2.0 male plug 90 is further inserted inwards and then gradually rotated to be horizontal, the gap "e" is greater than 0.38 mm, and the included angle "x" between the USB 2.0 male plug 90 and the connection slot 31 is equal to about 6.5 degrees. As shown in FIG. 8, when the USB 2.0 male plug 90 is further inserted inwards to a predetermined position, the connection point 94 of the USB 2.0 male plug 90 in the connection space 93 touches and is thus electrically connected to the first connection point 44 of the first terminal on the bottom surface of the tongue, the gap "e" is greater than 0.48 mm, and the half height (2.25 mm) of the USB 2.0 male plug 90 can be fit and positioned with the space height "f" (2.3 mm to 2.4 mm) below the tongue 20. Although the rear end of the tongue 20 is thicker to decrease the space height "f", the rear section of the connection slot 31 is formed with the concave surface 32 to provide the compensation. Thus, the USB 2.0 male plug 90 still can be inserted into the innermost end for positioning. At this time, the included angle between the USB 2.0 male plug 90 and the bottom surface of the connection slot 31 is equal to about 3 degrees. That is, the USB 2.0 male plug 90 is slantingly positioned within the connection slot 31 so that the connection points 94 of the male plug 90 in the connection space 93 are electrically connected to the one row of the first connection points 44. In addition, the two rows of first connection points 44 project beyond the two surfaces of the tongue 20 when the male plug 90 is not inserted, the tongue 20 has one end fixed to the plastic base 10 and the other end being a free end, and the tongue 20 is integrally located at the same position before and after the male plug 90 is inserted and positioned within the connection slot 31 and electrically connected to the electrical connector (see also FIG. 36).

Figure 9:
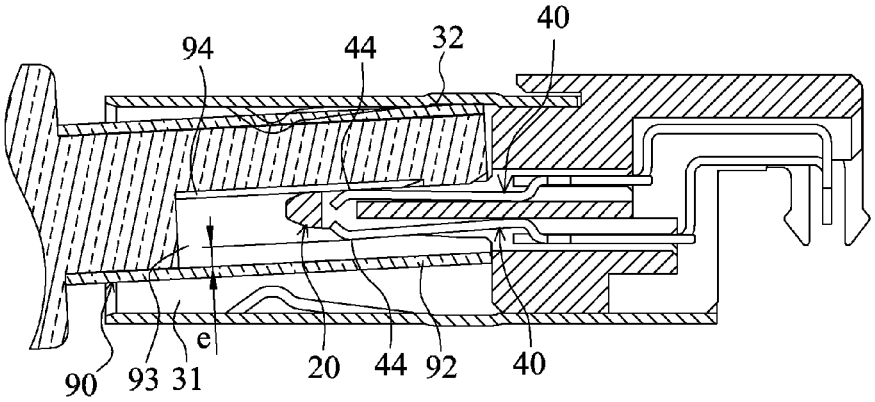
FIG. 9 is a cross-sectional side view showing the usage state of the first embodiment of the invention.

As shown in FIG. 9, the connection point 94 of the USB 2.0 male plug 90 faces downwards and the USB 2.0 male plug 90 is reversely inserted into the positioning state. At this time, the gap "e" is also greater than 0.48 mm, and the half height (2.25 mm) of the USB 2.0 male plug 90 is fit and positioned with the space height "f" (2.3 mm to 2.4 mm) above the tongue 20.

According to the above-mentioned description, it is obtained that, when the USB 2.0 male plug 90 is inserted into the connection slot 31 for positioning, the essential conditions that the metal housing 92 of the USB 2.0 male plug 90 does not touch the first connection point 44 reside in the thickness of the front section of the tongue 20 and the height of the first connection point 44 projecting beyond the front section of the tongue 20. Because the height "k" of the connection space of the USB 2.0 male plug 90 is equal to 1.95 mm and the first connection point 44 must have an elastically movable height of about 0.3 mm, the thickness of the front section of the tongue 20 cannot be greater than 1.55 mm in order to ensure that the metal housing 92 cannot touch the first connection point 44.

However, the user may not insert the plug exactly horizontally. If the insertion angle is too great, then the metal housing 92 of the USB 2.0 male plug 90 touches the first connection point 44 during the insertion process. The design factors affecting the maximum slanting insertion angle of the USB 2.0 male plug 90 reside in the height "c" of the connection slot and the horizontal distance "d" from the insert end 35 of the positioning plane of the connection slot 31 to the first connection point 44 of the first terminal 40. That is, the maximum inclined angle of inserting the USB 2.0 male plug 90 becomes smaller and the gap "e" becomes greater as the height "c" of the connection slot gets smaller and the horizontal distance "d" gets greater. This invention ensures the safety gap "e" by increasing the horizontal distance.

In this invention, the thickness of the tongue, the height "c" of the connection slot and the horizontal distance "d" from the insert end 35 of the positioning plane of the connection slot 31 to the first connection point 44 of the first terminal 40 are properly designed so that a whole new structure is provided for the USB plug to be bidirectionally inserted, connected and positioned without causing the short circuit.

Figure 10:
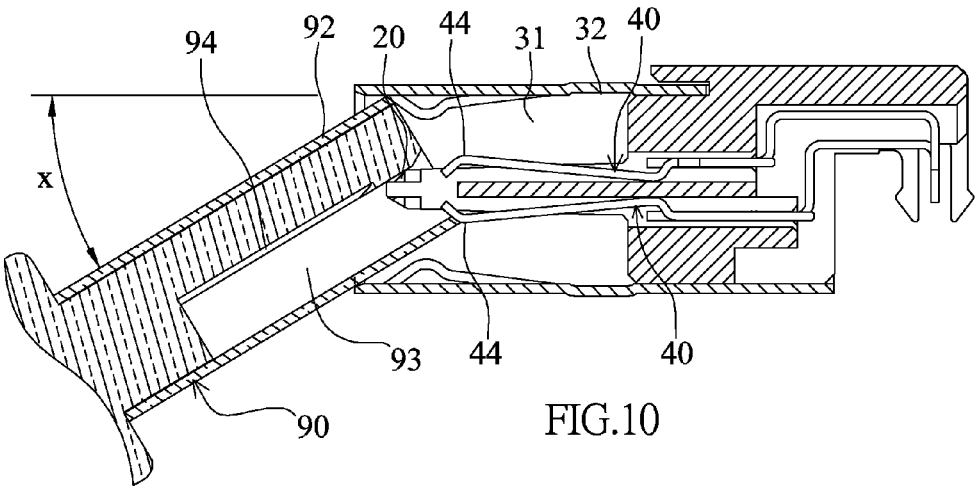
FIG. 10 is a cross-sectional side view showing the usage state of a second embodiment of the invention.

As shown in FIG. 10, the second embodiment of the invention is almost the same as the first embodiment except that the horizontal distance from the insert end of the positioning plane of the connection slot 31 to the first connection point 44 of the first terminal 40 is shorter in this embodiment. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 28 degrees, and the metal housing 92 touches the first connection point 44 on the bottom surface of the tongue to cause the short circuit. This is an incorrect embodiment, which mainly illustrates the short-circuited condition.

Figure 11:
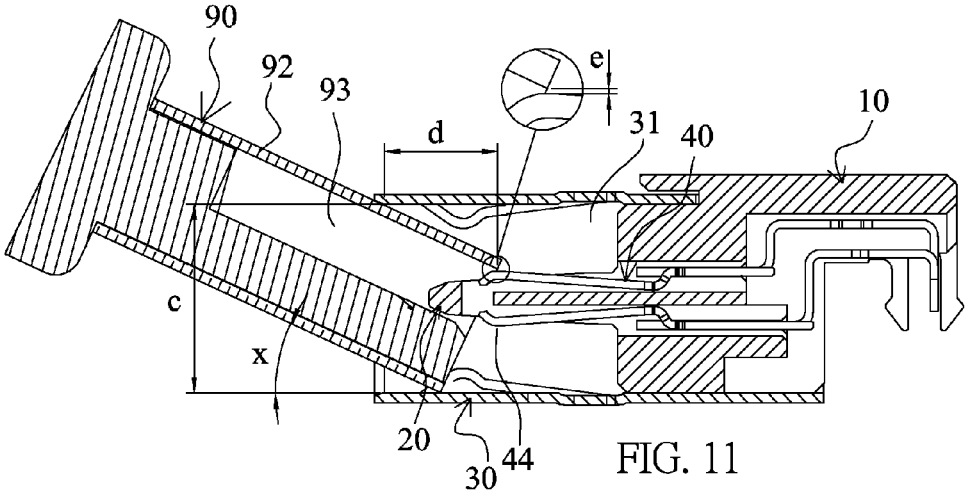
FIG. 11 is a cross-sectional side view showing the usage state of a third embodiment of the invention.

As shown in FIG. 11, the third embodiment of the invention is almost the same as the first embodiment except that the horizontal distance from the insert end of the positioning plane of the connection slot 31 of this embodiment to the first connection point 44 of the first terminal 40 is shorter and equal to about 3.55 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal about 24.5 degrees, and the gap "e" between the metal housing 92 and the first connection point 44 on the top surface of the tongue is still greater than 0.05 mm. So, the electrical connector still can be used without causing the short circuit.

Figure 12:
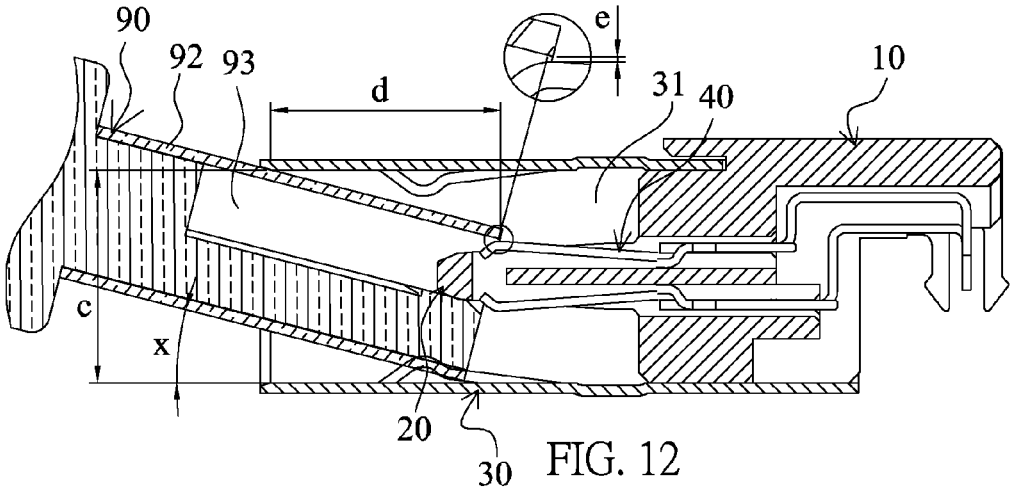
FIG. 12 is a cross-sectional side view showing the usage state of a fourth embodiment of the invention.

As shown in FIG. 12, the fourth embodiment of the invention is almost the same as the first embodiment except that the thickness of the front end of the tongue of this embodiment is increased and thus equal to about 1.3 mm, and the height "c" of the connection slot is also increased and equal to about 6.15 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 14.5 degrees, and the gap "e" between the metal housing 92 and the first connection point 44 on the top surface of the tongue is greater than 0.05 mm. The electrical connector still can be used without causing the short circuit.

Figure 13:
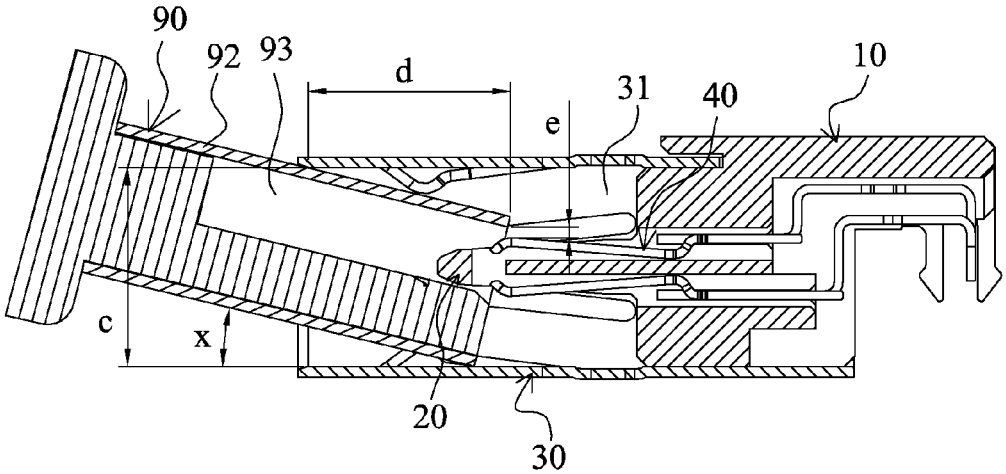
FIG. 13 is a cross-sectional side view showing the usage state of a fifth embodiment of the invention.

As shown in FIG. 13, the fifth embodiment of the invention is almost the same as the first embodiment except that the length of the metal casing 30 of this embodiment is shortened by 1 mm, and the first connection point 44 shrinks back 0.3 mm. So, the horizontal distance "d" from the insert end of the positioning plane of the connection slot 31 to the first connection point 44 of the first terminal 40 is equal to 5.9 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 13.5 degrees, and the gap "e" between the metal housing 92 and the first connection point 44 on the top surface of the tongue is greater than 0.27 mm.

Figure 14:
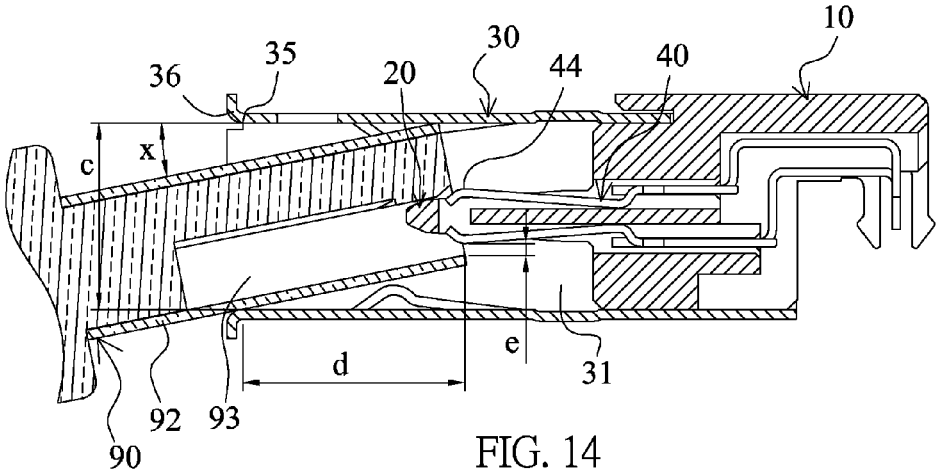
FIG. 14 is a cross-sectional side view showing the usage state of a sixth embodiment of the invention.

As shown in FIG. 14, the sixth embodiment of the invention is almost the same as the first embodiment except that the length of the metal casing 30 of this embodiment is lengthened by 0.5 mm and the front end of the metal casing 30 is bent outwards to form a guide-in inclined surface 36. So, the horizontal distance "d" from the insert end of the positioning plane of the connection slot 31 to the first connection point 44 of the first terminal 40 is equal to 7.1 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 11.2 degrees, and the gap "e" between the metal housing 92 and the first connection point 44 on the bottom surface of the tongue is greater than 0.3 mm.

Figure 15:
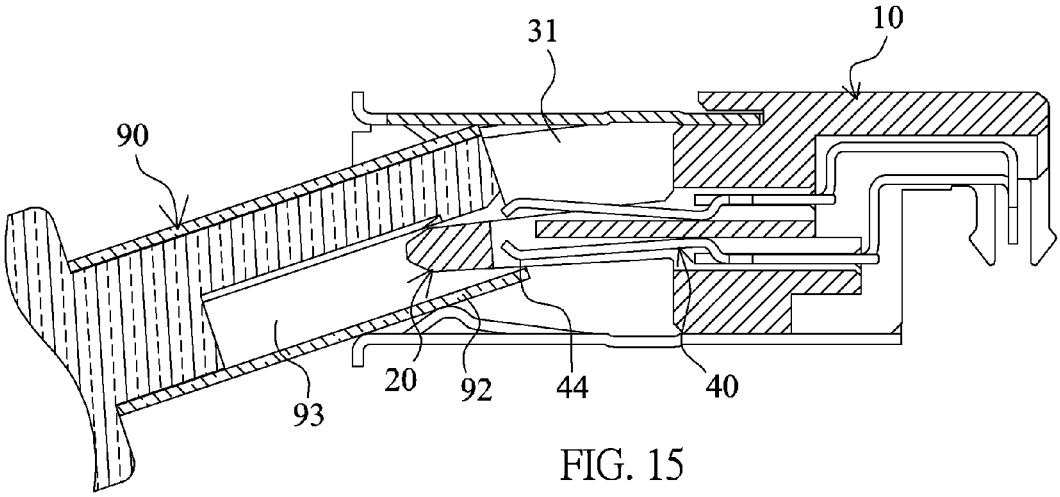
FIG. 15 is a cross-sectional side view showing the usage state of a seventh embodiment of the invention.

As shown in FIG. 15, the seventh embodiment of the invention is almost the same as the sixth embodiment except that the length of the metal casing 30 of this embodiment is shortened and the tongue 20 is lengthened. Thus, when the USB 2.0 male plug 90 is inserted into the connection slot 31 and reaches the first connection point 44 of the first terminal 40 with the too large inclined angle between the USB 2.0 male plug 90 and the connection slot 31, the distal end of the elastic arm of the first terminal 40 does not press against the tongue 20 because the tongue 20 is forced and bent. So, the first connection point 44 on the bottom surface of the tongue is kept unmoved and hidden into the tongue 20. Thus, the metal housing 92 further cannot touch the first connection point 44 on the bottom surface of the tongue.

Figure 16:
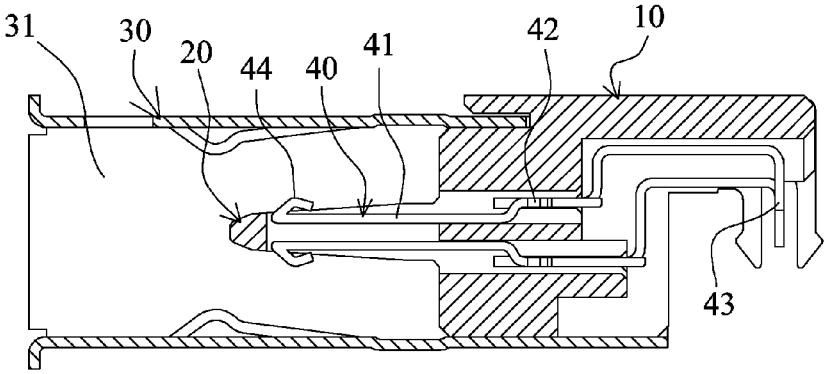
FIG. 16 is a cross-sectional side view showing the usage state of an eighth embodiment of the invention.

As shown in FIG. 16, the eighth embodiment of the invention is almost the same as the first embodiment except that the front section of the elastic arm 41 of the first terminal 40 of this embodiment is reversely bent to form the first connection point 44 projecting beyond one surface of the tongue 20. Thus, when the USB 2.0 male plug is inserted for electrical connection, the elastic arm 41 of the first terminal 40 is elastically moved forwardly in a smoother manner.

Figures 17, 18:
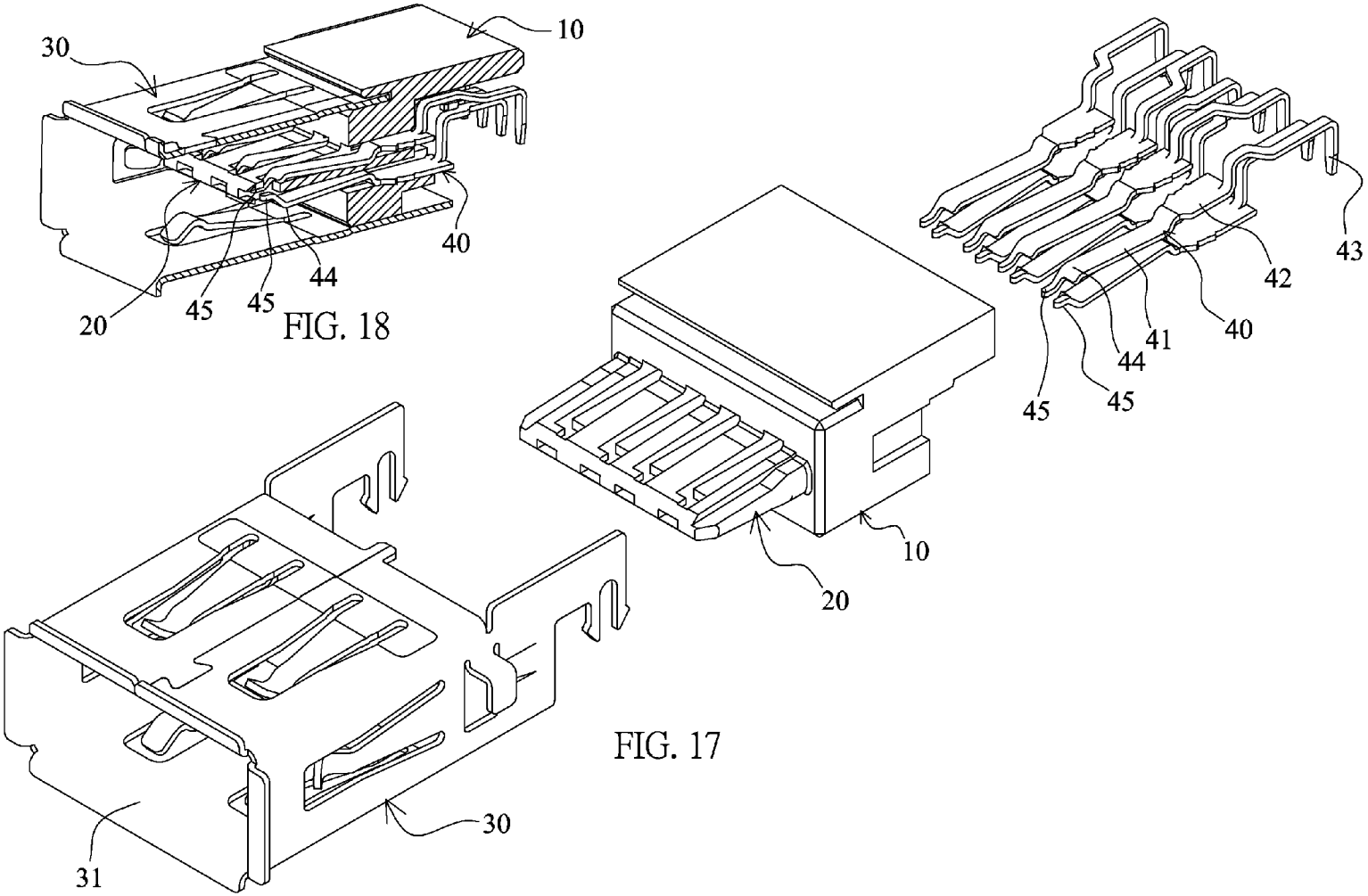
FIG. 17 is a pictorially exploded view showing a ninth embodiment of the invention.
FIG. 18 is a pictorially assembled view showing the ninth embodiment of the invention.

As shown in FIGS. 17 and 18, the ninth embodiment of the invention is almost the same as the first embodiment except that the front of the first connection point 44 of the elastic arm 41 of the first terminal 40 of this embodiment is formed with a guiding inclined surface 45 with the narrower plate surface. The guiding inclined surfaces 45 of the elastic arms 41 of the two rows of first terminals 40 are staggered in a left-to-right direction and have pre-loads pressing against the tongue 20. With this design, the first terminal 40 has the better elasticity, and the guiding inclined surfaces 45 of the two rows of first terminals 40 are staggered in the left-to-right direction to have the lager elastic moving space. However, the drawback is that the first connection point 44 of the first terminal 40 is still synchronously moved when the insertion inclined angle of the USB 2.0 male plug is too large to force and bend the tongue. Thus, the metal housing 92 may easily touch the first connection point 44 on one surface of the tongue.

As shown in FIGS. 19 and 20, the tenth embodiment of the invention is almost the same as the first embodiment except that the tongue 20 of this embodiment is an insulating flat plate, such as a glass fiber plate, having the good structural strength. Four lengthwise through holes 23 extending in the same direction as that of the elastic arm 41 of the first terminal 40 are disposed on the tongue. Each of the two surfaces of the tongue is formed with a bonding pad 24 in back of each through hole 23. Two sides of the rear section of the tongue are formed with two notches 25, respectively. The plastic base 10 has an upper seat 15 and a lower seat 12. Two engaging blocks 13 are formed on two inner sides of the lower seat 12, respectively.

During assembling, the fixing portions 42 of the two rows of first terminals 40 are bonded to the bonding pads 24, the notches 25 of the tongue 20 are engaged with the engaging blocks 13 of the lower seat 12, and then the upper seat 15 covers the lower seat 12. Finally, the metal casing 30 is fit with and fixed to the front end of the plastic base 10.

As shown in FIGS. 21 to 23, the eleventh embodiment of the invention is a USB 3.0 socket, which may be electrically connected to a USB 3.0 male plug and includes a plastic base 10, a tongue 20, a metal casing 30 and two rows of first terminals 40.

The front end of the plastic base 10 is integrally formed with a frontwardly projecting tab 18, a transversal fitting hole 19 is formed in the tab 18, and a lower cover 17 covers the bottom of the plastic base 10.

As shown in FIG. 23, the rear section of the tongue 20 is the tab 18 integrally formed with the plastic base, and the front section of the tongue 20 is a circuit board 210. The tab 18 is thicker than the circuit board 210, so the front sections of the two surfaces of the tongue 20 are the thinner and lower concave surfaces 26, and the rear sections of the two surfaces of the tongue are the thicker and higher convex surfaces 27. A step is formed between the concave surface 26 and the convex surface 27 so that the cross-sectional side view of the tongue 20 forms a convex shape. Each of the front sections of the two surfaces of the circuit board 210 is separately arranged with five second connection points 211, each of the rear sections of the two surfaces is separately arranged with five bonding points 212. Each second connection point 211 is connected to one bonding point 212 via a trace 213. Each bonding point 212 is bonded to a pin 216. In addition, four through holes 214 are formed on the circuit board. The circuit board 210 is assembled and fixed into the plastic base 10 from the rear side. The front section of the circuit board 210 passes through the fitting hole 19 of the tab 18 and projects beyond the front end of the tab 18 to form the front section of the tongue 20.

A connection slot 31 is formed inside the metal casing 30. The metal casing 30 is disposed at the front end of the plastic base 10 and covers the tongue 20 therein. The inner section of the connection slot 31 is formed with the concave surface 32. The front end of the insert end 35 of the positioning plane of the connection slot 31 is formed with a guide-in inclined surface 36.

Each row of first terminals 40 has four terminals. The first terminal 40 has an elastic arm 41, a fixing portion 42 and a pin 43. The fixing portion 42 is positioned within the plastic base 10. The elastic arm 41 extends toward the connection slot 31 and is formed with a projecting first connection point 44 projecting beyond the convex surface 27 of the tongue 20.

This embodiment is characterized in that the spaces of the connection slot 31 on the two surfaces of the tongue 20 allow the USB 3.0 male plug to be bidirectionally inserted and positioned. In addition, when the USB 3.0 male plug is inserted into the connection slot 31 and reaches a horizontal position of the first connection point 44 of the first terminal 40 with a maximum inclined angle between the USB 3.0 male plug and the connection slot 31, a gap between the metal housing of the USB 3.0 male plug and the first connection point is greater than 0.05 mm to prevent the short circuit.

To satisfy the requirements on the bidirectionally electrical connection and the elimination of the short circuit, this embodiment adopts the following designs. The thickness of the circuit board of the front section of the tongue is equal to 0.6 mm; the thickness "a" of the front end of the tab 18 of the rear section of the tongue is equal to about 1.0 mm; the thickness "b" of the rear end of the tab is equal to about 1.6 mm; the height "c" of the connection slot is equal to about 5.8 mm; the horizontal distance "d" from the insert end 35 of the positioning plane of the connection slot 31 to the first connection point 44 of the first terminal 40 is equal to about 6.6 mm; and the space height "f" beside the two surfaces of the rear section of the tongue is equal to about 2.3 mm to 2.4 mm. That is, the parameter "f" of the front end of the rear section of the tongue is equal to (5.8 mm−1 mm)/2=2.4 mm, and is gradually decreased toward the rear end of the tongue. Because the parameter "f" beside the two surfaces of the rear section of the tongue is still greater than 2.3 mm, the concave surface 32 is provided.

Figure 24:
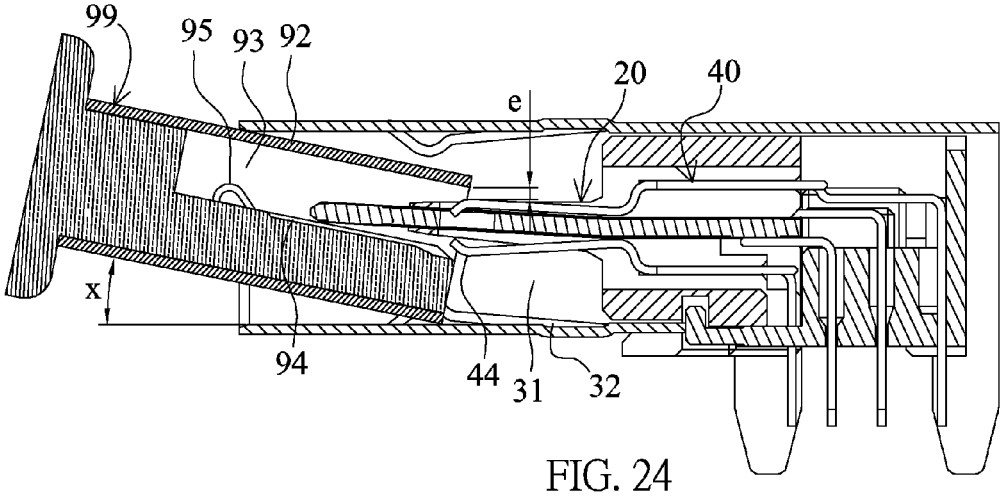
FIG. 24 is a cross-sectional side view showing the usage state of the eleventh embodiment of the invention.
Figure 25:
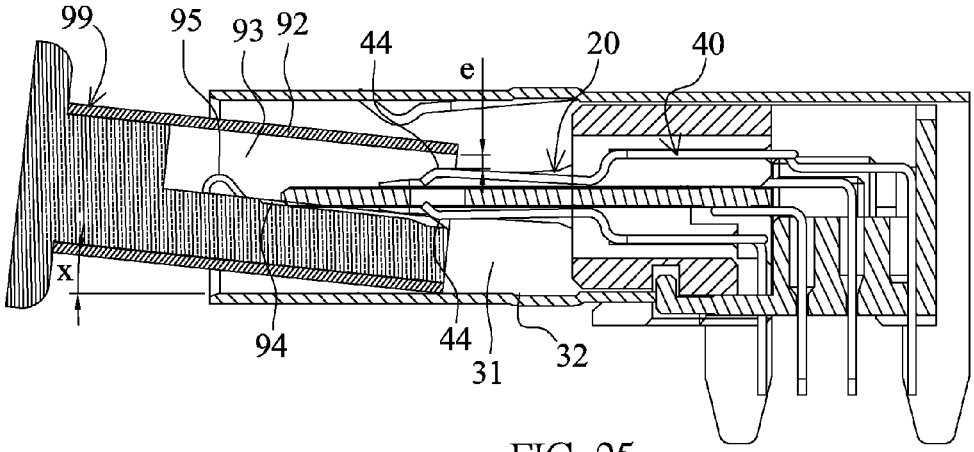
FIG. 25 is a cross-sectional side view showing the usage state of the eleventh embodiment of the invention.
Figure 26:
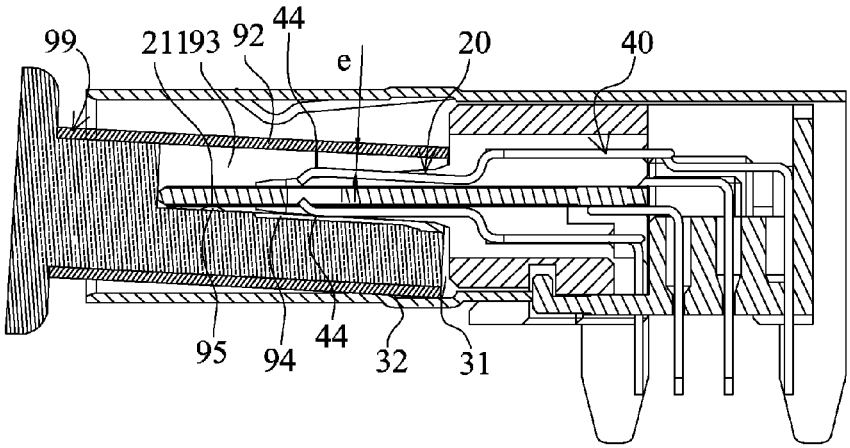
FIG. 26 is a cross-sectional side view showing the usage state of the eleventh embodiment of the invention.

The following operation description illustrates that the metal housing 92 of the USB 3.0 plug cannot touch the first connection point 44 of the first terminal 40 when the USB 3.0 plug is slantingly inserted into the connection slot at any inclined angle. As shown in FIG. 24, the dimensions and specifications of the USB 3.0 plug 99 are almost the same as those of the USB 2.0 plug 90 except that the USB 3.0 plug 99 additionally includes one row of five inner connection point 95, which can be elastically moved. When the connection point 94 of the USB 3.0 male plug 99 faces upwards and the USB 3.0 male plug 99 is inserted into the connection slot 31 and reaches the first connection point 44 of the first terminal 40 with the maximum inclined angle between the USB 3.0 male plug 99 and the connection slot 31, the included angle "x" between the USB 3.0 male plug 99 and the connection slot 31 is about 11.5 degrees, the tongue 20 is accommodated within the connection space 93 of the USB 3.0 male plug 99, and the gap "e" between the metal housing 92 and the first connection point 44 on the top surface of the tongue is still greater than 0.3 mm to prevent the short circuit from occurring. As shown in FIG. 25, when the USB 3.0 male plug 99 is further inserted inwards and then gradually rotated to be horizontal, the gap "e" is greater than 0.38 mm, and the included angle "x" between the USB 3.0 male plug 99 and the connection slot 31 is equal to about 6.5 degrees. As shown in FIG. 26, when the USB 3.0 male plug 99 is further inserted inwards to a predetermined position, the connection point 94 of the USB 3.0 male plug 99 touches the first connection point 44 of the first terminal on the bottom surface of the rear section of the tongue, and the inner connection point 95 touches the second connection point 211 on the bottom surface of the front section of the tongue. At this time, the gap "e" is greater than 0.48 mm, and the half height (2.25 mm) of the USB 3.0 male plug 99 can be tightly fit and positioned with the space height "f" (2.3 mm to 2.4 mm) below the tongue 20. Although the rear end of the tongue 20 is thicker to decrease the space height "f", the rear section of the connection slot 31 is formed with the concave surface 32 to provide the compensation. Thus, the USB 3.0 male plug 99 still can be inserted into the innermost end for positioning.

Similarly, when the connection point 94 of the USB 3.0 male plug 99 faces upwards and the USB 3.0 male plug 99 is inserted for positioning, the state is also the same as that mentioned hereinabove. Thus, detailed descriptions thereof will be omitted.

According to the above-mentioned description, it is obtained that, when the USB 3.0 male plug 99 is inserted into the connection slot 31 for positioning, the essential conditions that the metal housing 92 of the USB 3.0 male plug 99 does not touch the first connection point 44 reside in the thickness of the front end of the rear section of the tongue 20 and the height of the first connection point 44 projecting beyond the rear section of the tongue 20. Because the height "k" of the connection space of the USB 3.0 male plug 99 is equal to 1.95 mm and the first connection point 44 must have an elastically movable height of about 0.3 mm, the thickness of the front end of the rear section of the tongue 20 cannot be greater than 1.55 mm in order to ensure that the metal housing 92 cannot touch the first connection point 44.

However, the user may not insert the plug exactly horizontally. If the insertion angle is too great, then the metal housing 92 of the USB 3.0 male plug 99 touches the first connection point 44 during the insertion process. The design factors affecting the maximum slanting insertion angle of the USB 3.0 male plug 99 reside in the height "c" of the connection slot and the horizontal distance "d" from the insert end 35 of the positioning plane of the connection slot 31 to the first connection point 44 of the first terminal 40. That is, the maximum inclined angle of inserting the USB 3.0 male plug 99 becomes smaller and the gap "e" becomes greater as the height "c" of the connection slot gets smaller and the horizontal distance "d" gets greater.

Figure 27:
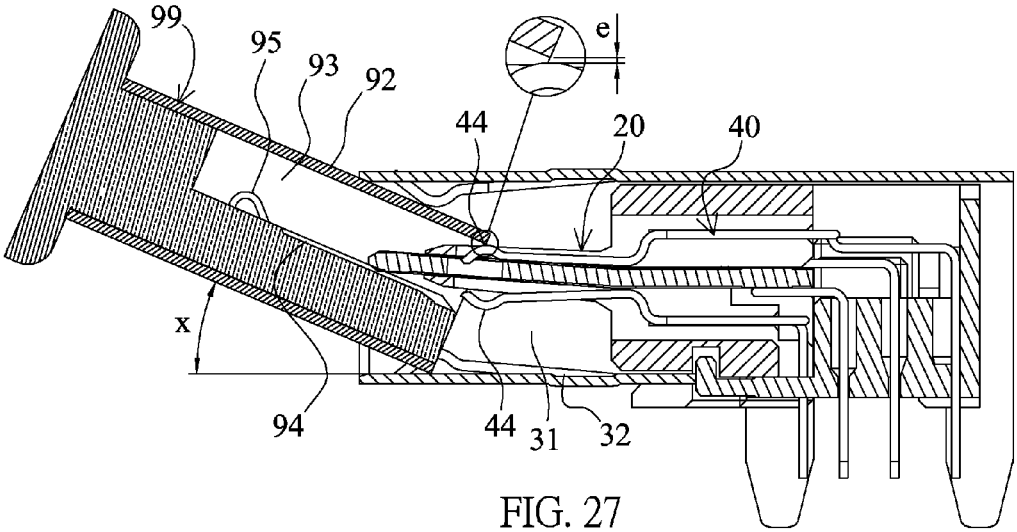
FIG. 27 is a cross-sectional side view showing a usage state of a twelfth embodiment of the invention.

As shown in FIG. 27, the twelfth embodiment of the invention is almost the same as the eleventh embodiment except that the horizontal distance from the insert end of the positioning plane of the connection slot 31 to the first connection point 44 of the first terminal 40 of this embodiment is shorter and equal to about 3.6 mm. When the USB 3.0 male plug 99 is inserted into the connection slot 31 and reaches the horizontal position of the first connection point 44 of the first terminal 40 with the maximum inclined angle between the USB 3.0 male plug 99 and the connection slot 31, the included angle "x" between the USB 3.0 male plug 99 and the connection slot 31 is equal to about 24 degrees, and the gap "e" between the metal housing 92 and the first connection point 44 on the top surface of the tongue is greater than 0.05 mm. The electrical connector still can be used without causing the short circuit.

Figure 28:
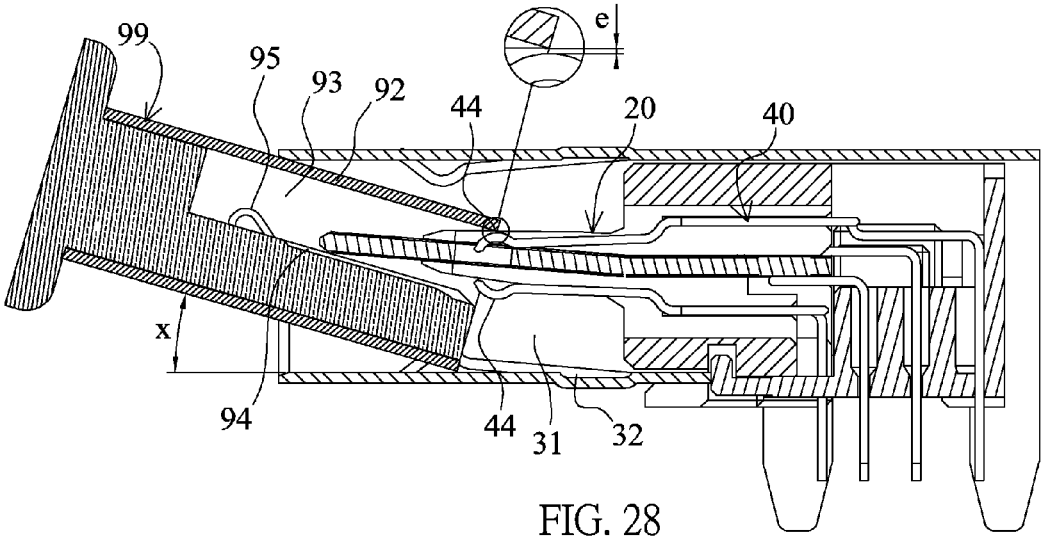
FIG. 28 is a cross-sectional side view showing a usage state of a thirteenth embodiment of the invention.

As shown in FIG. 28, the thirteenth embodiment of the invention is almost the same as the eleventh embodiment except that the thickness of the front end of the rear section of the tongue of this embodiment is increased and equal to about 1.3 mm, and the height "c" of the connection slot is also increased and equal to about 6.2 mm. When the USB 3.0 male plug 99 is inserted into the connection slot 31 and reaches the horizontal position of the first connection point 44 of the first terminal 40 with the maximum inclined angle between the USB 3.0 male plug 99 and the connection slot 31, the included angle "x" between the USB 3.0 male plug 99 and the connection slot 31 is equal to about 16 degrees, and the gap "e" between the metal housing 92 and the first connection point 44 on the top surface of the tongue is still greater than 0.05 mm. The electrical connector still can be used without causing the short circuit.

Figure 29:
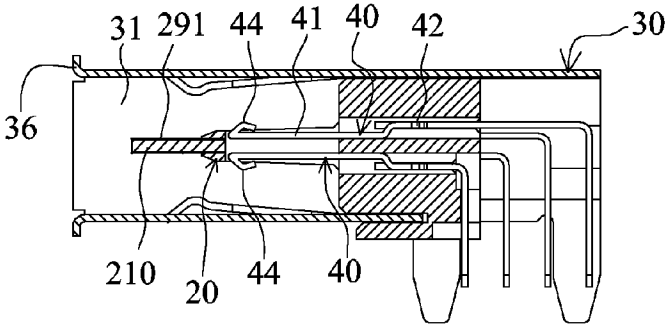
FIG. 29 is a cross-sectional side view showing a fourteenth embodiment of the invention.

As shown in FIG. 29, the fourteenth embodiment of the invention is almost the same as the eleventh embodiment except that the front section of the elastic arm 41 of the first terminal 40 of this embodiment is reversely bent to form the first connection point 44 projecting beyond one surface of the tongue 20. Thus, when the USB 3.0 male plug is inserted for electrical connection, the elastic arm 41 of the first terminal 40 is elastically moved forwardly in a smoother manner.

Figure 30:
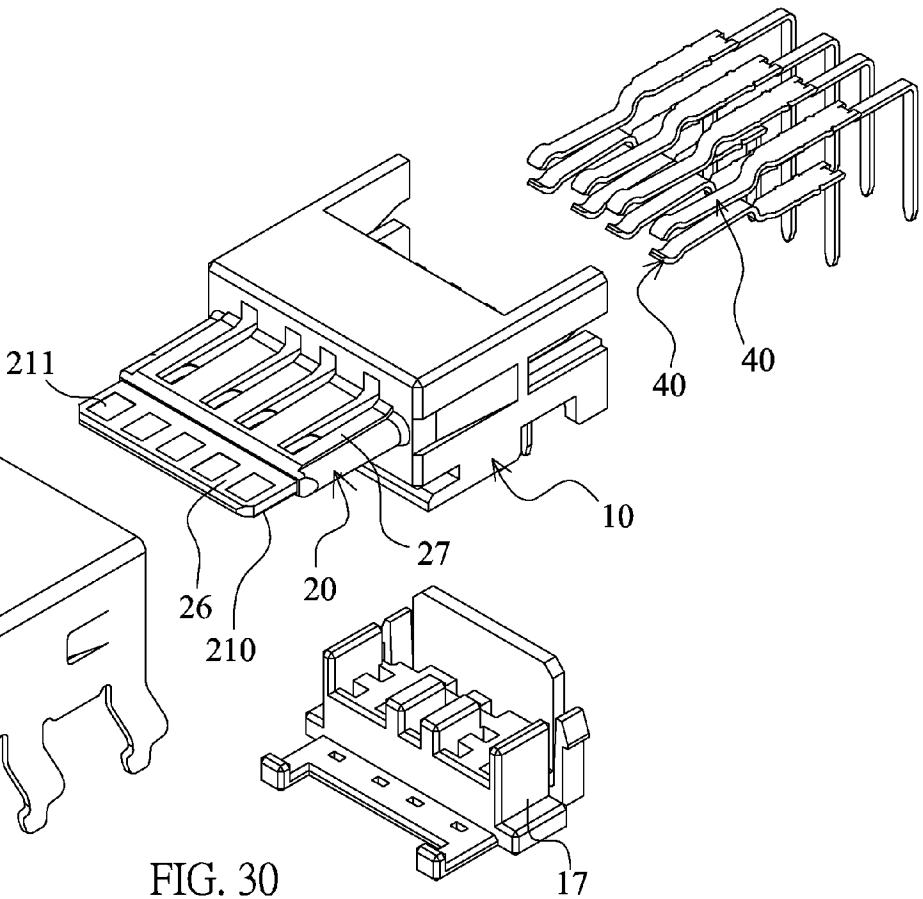
FIG. 30 is a pictorially exploded view showing a fifteenth embodiment of the invention.

As shown in FIG. 30, the fifteenth embodiment of the invention is almost the same as the eleventh embodiment except that the plastic base 10 of this embodiment is embedded with the circuit board 210 and then injection molded to position the circuit board 210.

Figure 31:
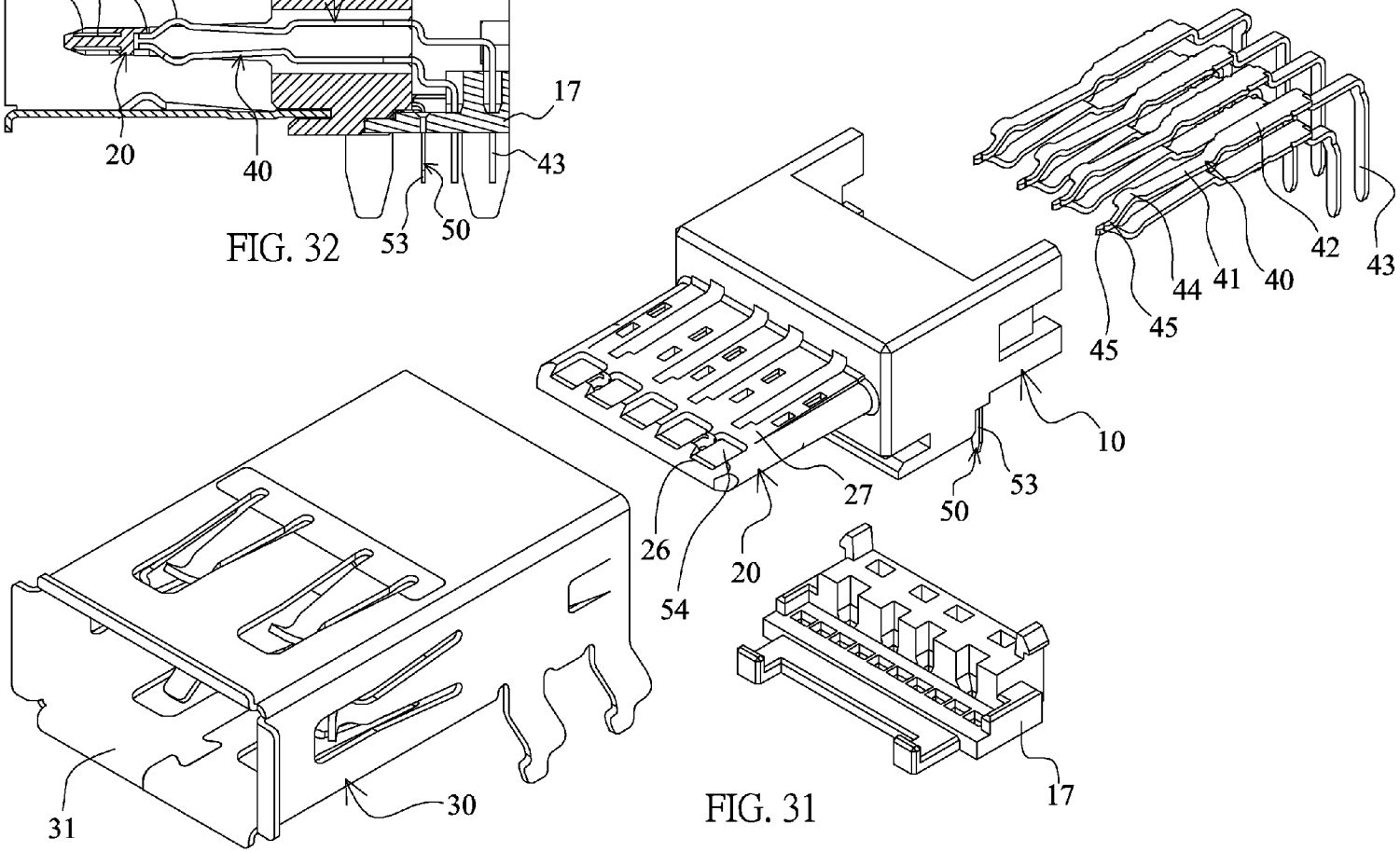
FIG. 31 is a pictorially exploded view showing a sixteenth embodiment of the invention.
Figure 32:
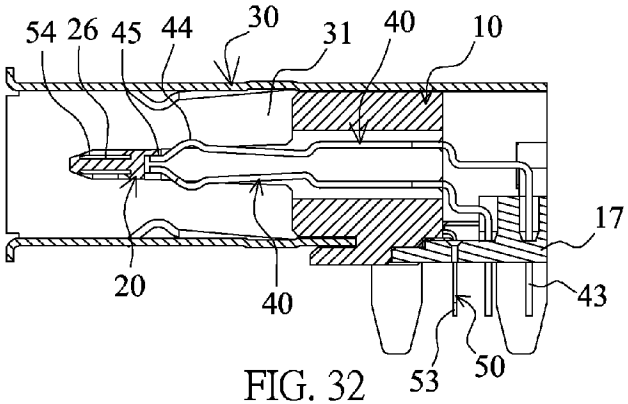
FIG. 32 is a cross-sectional side view showing the sixteenth embodiment of the invention.

As shown in FIGS. 31 and 32, the sixteenth embodiment of the invention is almost the same as the eleventh embodiment except that the front of the first connection point 44 of the elastic arm 41 of the first terminal 40 of this embodiment is formed with a guiding inclined surface 45 with the narrower plate surface. The guiding inclined surfaces 45 of the elastic arms 41 of the two rows of first terminals 40 are staggered in a left-to-right direction and have pre-loads pressing against the tongue 20. With this design, the first terminal 40 has the better elasticity, and the guiding inclined surfaces 45 of the two rows of first terminals 40 are staggered in the left-to-right direction to have the lager elastic moving space. However, the drawback is that the first connection point 44 of the first terminal 40 is still synchronously moved when the insertion inclined angle of the USB 3.0 male plug is too large to force and bend the tongue. Thus, the metal housing 92 may easily touch the first connection point 44 on one surface of the tongue.

In addition, two rows of second terminals 50 are embedded into the plastic base 10 of this embodiment and are positioned when the plastic base 10 is injection molded. The second terminal 50 has a second connection point 54, which cannot be elastically moved, and a pin 53 extending out of the plastic base 10. The tapered tongue 20 and the plastic base 10 are integrally formed. That is, the tongue 20 has the thinner front end and the thicker rear end. The front section of the tongue 20 is formed with the thinner and lower concave surface 26, and the rear section thereof is formed with the thicker and higher convex surface 27. A step is formed between the concave surface 26 of the front section of the two surfaces of the tongue and the convex surface 27 of the rear section, so that the cross-sectional side view of the tongue 20 forms a convex shape. The second connection points of the two rows of second terminals 50 are respectively arranged on the concave surfaces 26 of the front sections of the two surfaces of the tongue. The first connection points 44 of the two rows of first terminals 40 are respectively projectingly arranged on the convex surfaces 27 of the rear sections of the two surfaces of the tongue. One end of the tongue 20 is fixed to the plastic base 10, and the other end of the tongue 20 is a free end.

Figure 33:
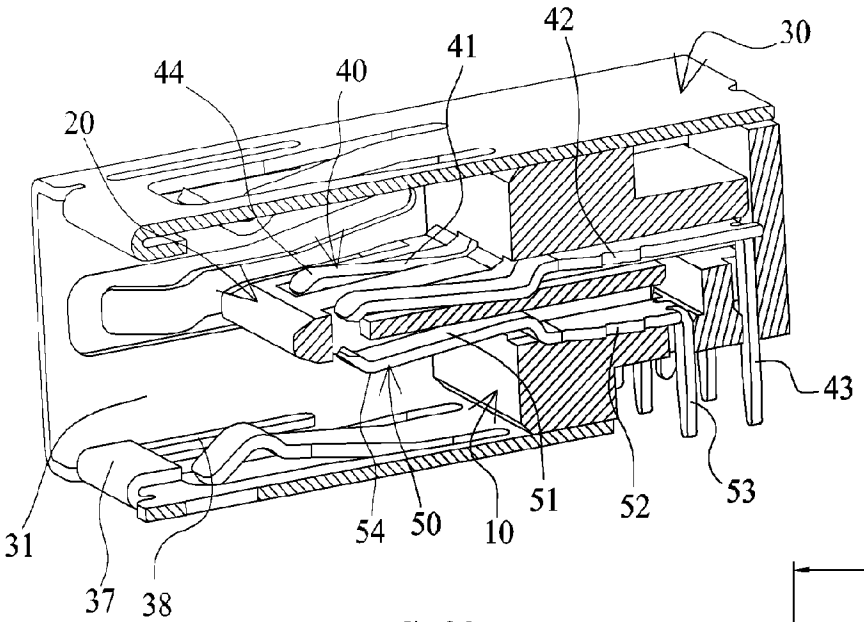
FIG. 33 is a pictorially cross-sectional view showing a seventeenth embodiment of the invention.
Figure 34:
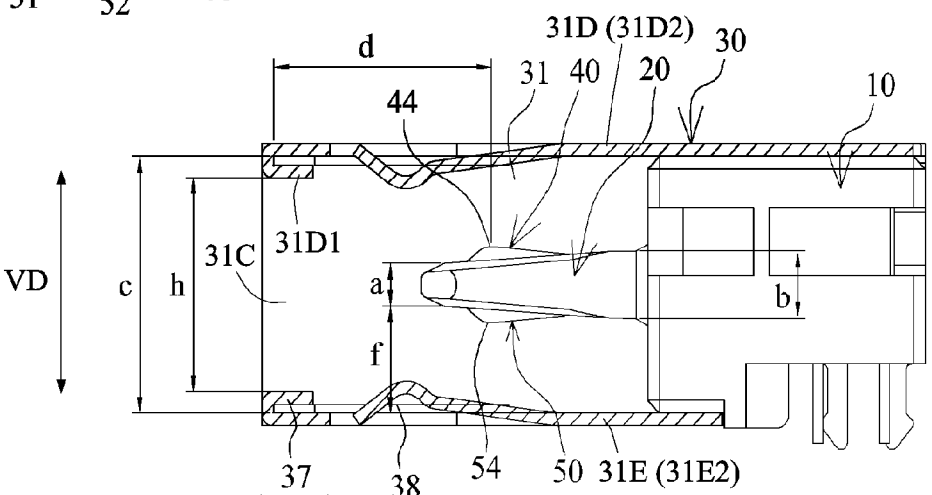
FIG. 34 is a cross-sectional side view showing the seventeenth embodiment of the invention.

As shown in FIGS. 33 and 34, the seventeenth embodiment of the invention is a USB 2.0 socket, which includes a plastic base 10, a tongue 20, a metal casing 30 and two rows of first terminals 40.

The tongue 20 integrally projects beyond the front end of the plastic base 10, and has a thinner front end and a thicker rear end so that it is tapered from rear to front. Thus, the tongue is stronger and cannot be easily broken.

The metal casing 30 is formed with a connection slot 31. The metal casing 30 is disposed at the front end of the plastic base 10 and covers the tongue 20 therein. The top surface and the bottom surface of the insert port of the connection slot 31 are formed with projections 37 projecting toward a center of the connection slot. The vertical distance between the projections 37 on the top and bottom surfaces is the height h of the insert port. So, the height h of the insert port is smaller than the height "c" of the connection slot inside the insert port, so that the gap can be decreased when the male plug is inserted for connection to prevent the wobble. The projection 37 is formed by reversely bending the front end of the metal casing 30 toward the inside of the connection slot 31. In addition, the top surface and the bottom surface of the front section of the connection slot 31 are formed with two projections 38 extending from front to rear.

Each row of first terminals 40 has four terminals. The first terminal 40 has an elastic arm 41, a fixing portion 42 and a pin 43. The fixing portion 42 is positioned within the plastic base 10. The elastic arm 41 extends toward the connection slot 31 and is formed with a projecting first connection point 44 projecting beyond one surface of the tongue 20. The first connection points 44 of the two rows of first terminals 40 respectively project beyond the two surfaces of the tongue 20.

The designed dimensions are listed in the following. The thickness "a" of the front end of the tongue is about 1 mm, the thickness "b" of the rear end of the tongue is about 1.6 mm, the height "c" of the connection slot is about 6 mm and the height of the projection 37 is 0.5 mm. So, the height h of the insert port of the connection slot is 5.0 mm, the horizontal distance "d" from the insert end 35 of the positioning plane of the connection slot 31 to the first connection point 44 of the first terminal 40 is equal to about 5.6 mm, and the heights "f" of spaces beside the two surfaces of the tongue are equal to about 2.5 mm to 2.2 mm. That is, the parameter "f" at the front end of the tongue is equal to (6 mm−1 mm)/2=2.5 mm, and is gradually decreased toward the rear end of the tongue. In this embodiment, the connection slot 31 comprises a top portion 31D and a bottom portion 31E opposite to the top portion 31D, a direction from the top portion 31D to the bottom portion 31E is defined as a vertical direction VD, each of the top portion 31D and the bottom portion 31E has a front section 31D1 (31E1) close to an insert port 31C of the connection slot 31, and a rear section 31D2 (31E2) away from the insert port 31C of the connection slot 31, a shortest distance h from the front section 31D1 of the top portion 31D to the front section 31E1 of the bottom portion 31E in the vertical direction VD is smaller than a shortest distance c from the rear section 31D2 of the top portion 31D to the rear section 31E2 of the bottom portion 31E in the vertical direction VD, so that when the male plug 90 (see FIG. 36) is bidirectionally inserted and slantingly positioned in the connection slot 31, the male plug 90 is in direct contact with the front section 31D1 of the top portion 31D and the rear section 31D2 of the top portion 31D (see FIG. 36, dashed lines of the male plug 90), or the male plug 90 is in direct contact with the front section 31E1 of the bottom portion 31E and the rear section 31E2 of the bottom portion 31E (see FIG. 36, solid lines of the male plug 90). The front section 31D1 of the top portion 31D and the front section 31E1 of the bottom portion 31E of the connection slot 31 are formed with the projections 37. The height h of the insert port 31C is smaller than the height c of the connection slot 31 inside the insert port 31C from the rear section 31D2 of the top portion 31D to the rear section 31E2 of the bottom portion 31E.

Figure 35:
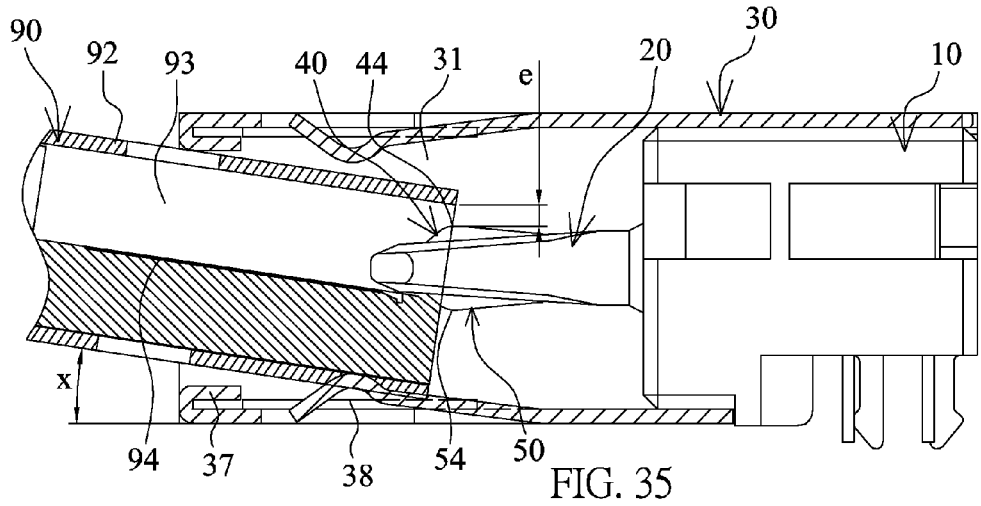
FIG. 35 is a cross-sectional side view showing a usage state of the seventeenth embodiment of the invention.
Figure 36:
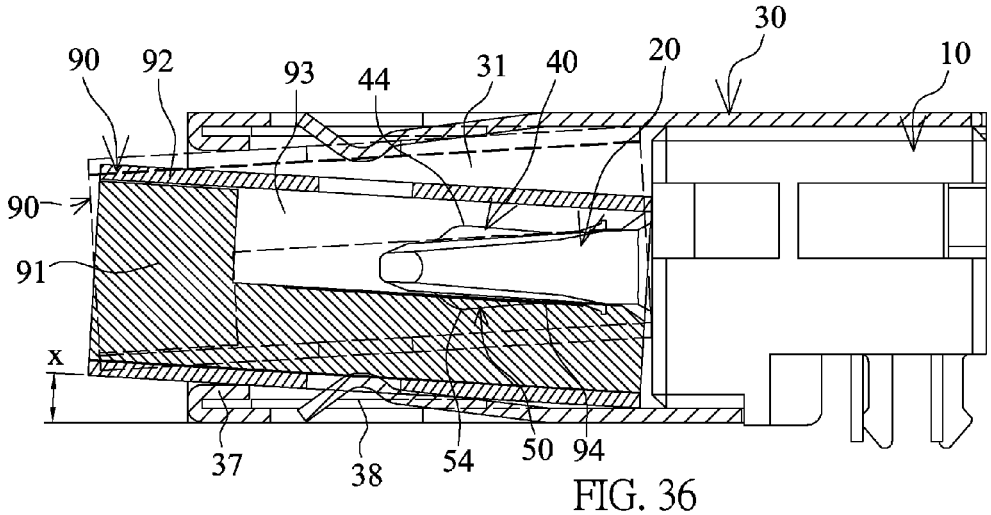
FIG. 36 is a cross-sectional side view showing the usage state of the seventeenth embodiment of the invention.

As shown in FIG. 35, the connection point 94 of the USB 2.0 male plug 90 faces upwards and the USB 2.0 male plug 90 is normally inserted into the insert port and tilts downwards (the pictorial view when the USB 2.0 male plug 90 is normally inserted and tilts downwards is illustrated in FIG. 1A). Thus, when the USB 2.0 male plug 90 is inserted into the connection slot 31 and reaches the horizontal position of the first connection point 44 of the first terminal 40 with a maximum inclined angle between the male plug 90 and the connection slot 31, the included angle "x" between the USB 2.0 male plug 90 and the connection slot 31 is about 8.8 degrees, the tongue 20 is accommodated within the connection space 93 of the USB male plug, and the gap "e" between the metal housing 92 and the first connection point 44 on the top surface of the tongue is greater than 0.48 mm to prevent the short circuit from occurring. As shown in FIG. 36, when the USB 2.0 male plug 90 is further inserted inwards and then gradually rotated to be horizontal, the gap "e" is increased because the USB 2.0 male plug 90 is gradually rotated to be horizontal so that the short circuit cannot be further caused. At this time, the included angle "x" between the USB 2.0 male plug 90 and the connection slot 31 is equal to about 3.4 degrees and the USB 2.0 male plug 90 tilts downwards and is slantingly positioned, and the half height (2.25 mm) of the USB 2.0 male plug 90 can be fit and positioned with the space height "f" (2.5 mm to 2.2 mm) below the tongue 20. Although the rear end of the tongue 20 is thicker to decrease the space height "f", the USB 2.0 male plug 90 can be fit with the connector because the USB 2.0 male plug 90 is slantingly positioned.

Figure 1B:
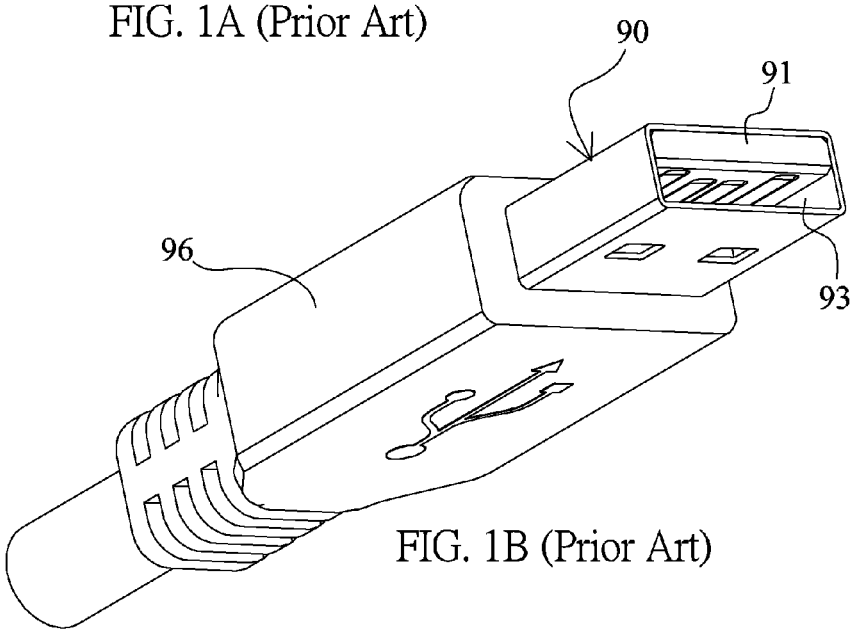
FIG. 1B (Prior Art)
FIG. 1B is a pictorial view showing the conventional USB 2.0 male plug, which is reversely inserted and tilts upwards.
Figure 2:
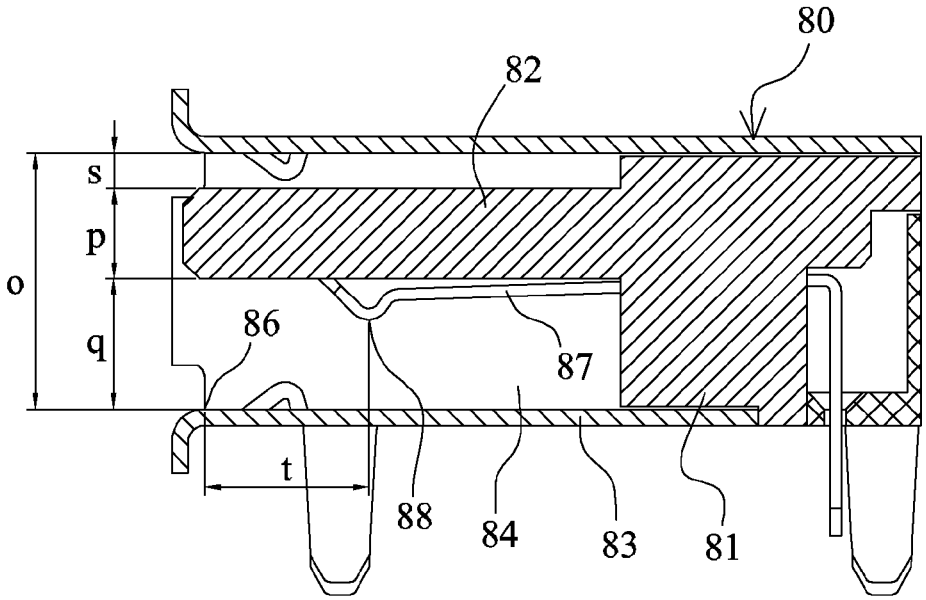
FIG. 2 (Prior Art)
FIG. 2 is a cross-sectional side view showing a conventional USB 2.0 socket.
Figure 2A:
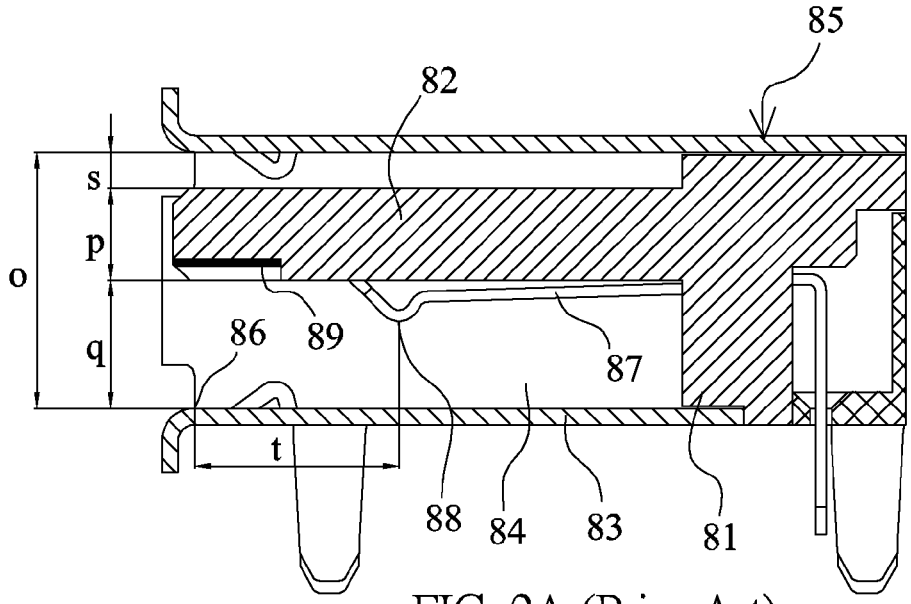
FIG. 2A (Prior Art)
FIG. 2A is a cross-sectional side view showing a conventional USB 3.0 socket.

The dashed line in FIG. 36 represents that the USB 2.0 male plug 90 is inwardly and reversely inserted from the insert port with the connection point 94 facing downwards and tilts upwards (FIG. 1B is a pictorial view showing the convention USB 2.0 male plug, which is reversely inserted and tilts upwards) and upwardly and slantingly positioned. Because the connection slot 31 can make the USB 2.0 male plug 90 be either normally inserted and tilt downwards or be reversely inserted and tilt upwards so that the bidirectionally inserted USB 2.0 male plug 90 can be slantingly positioned, and the USB 2.0 male plug 90, which is normally inserted and tilts downwards, and the USB 2.0 male plug 90, which is reversely inserted and tilts upwards, cross each other. So, the maximum overlap area exists at the position of the insert port of the connection slot, such that the height h of the insert port can be decreased.

The feature of this embodiment resides in that the top surface and the bottom surface of the insert port of the connection slot 31 are formed with projections 37 to decrease the height h of the insert port. Thus, the maximum inclined angle of inserting the USB 2.0 male plug 90 can be decreased to prevent the short circuit, decrease the insert gap and prevent the wobble. In addition, two ribs 38, extending from front to rear, are formed on the top surface and the bottom surface of the front section of the connection slot 31 so that the above-mentioned effect can be enhanced.

Furthermore, because the tongue 20 is tapered, the USB 2.0 male plug is inserted into the connection slot 31 and slantingly positioned. This embodiment adopts the projection 37 to decrease the height of the insert port. Thus, when the USB 2.0 male plug 90 is inserted for connection, the USB 2.0 male plug 90 can be connected at the insert port of the connection slot and can be stably positioned.

Figure 37:
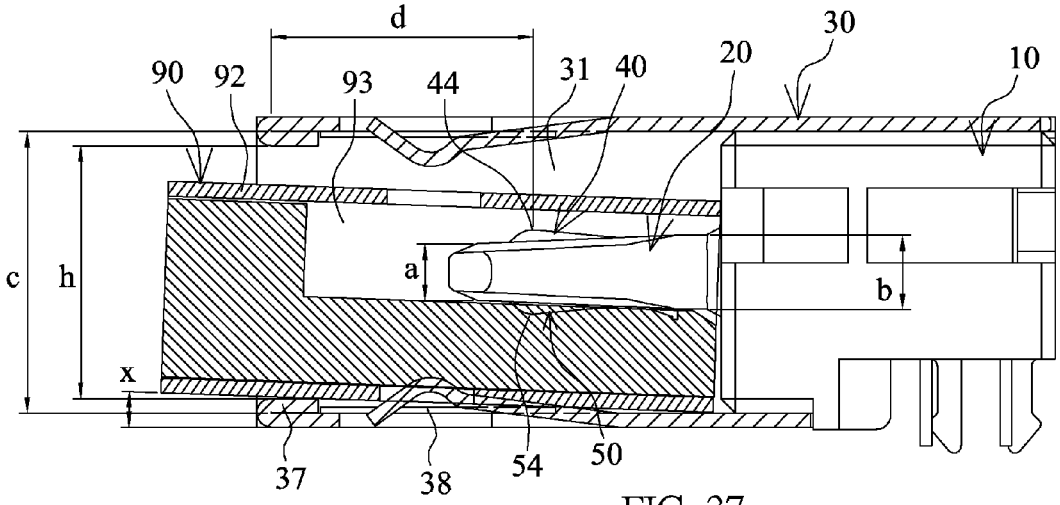
FIG. 37 is a cross-sectional side view showing an eighteenth embodiment of the invention.

As shown in FIG. 37, the eighteenth embodiment of the invention is almost the same as the seventeenth embodiment except that the thickness "a" of the front end of the tongue 20 of this embodiment is increased to 1.2 mm, the height of the projection 37 is decreased to 0.3 mm, and the height h of the insert port is increased to 5.4 mm. At this time, the positioning included angle "x" between the USB 2.0 male plug 90 and the connection slot 31 is equal to about 2.05 degrees.

Figure 38:
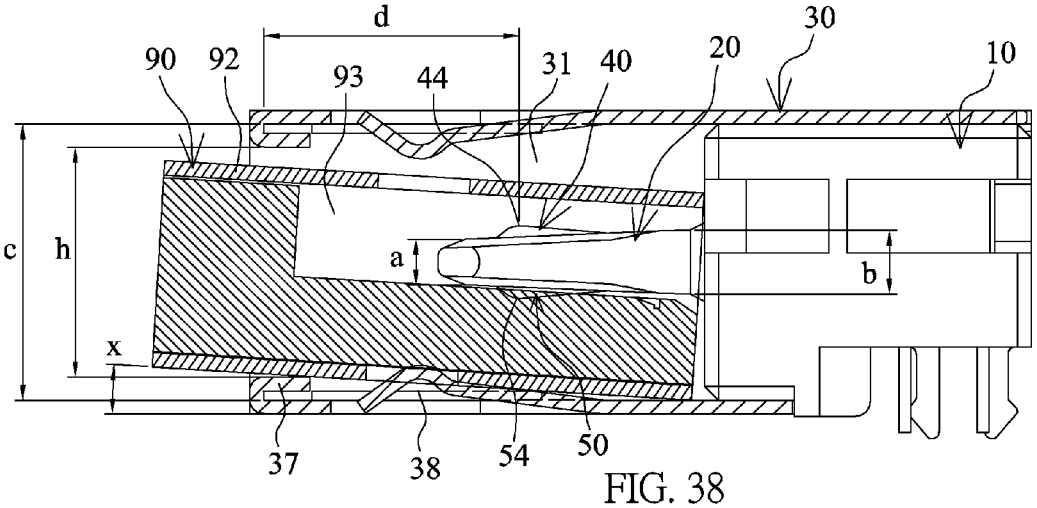
FIG. 38 is a cross-sectional side view showing a nineteenth embodiment of the invention.

As shown in FIG. 38, the nineteenth embodiment of the invention is almost the same as the seventeenth embodiment except that the thickness "b" of the rear end of the tongue 20 of this embodiment is decreased to 1.4 mm. At this time, the positioning included angle "x" between the USB 2.0 male plug 90 and the connection slot 31 is equal to about 3.5 degrees.

Figure 39:
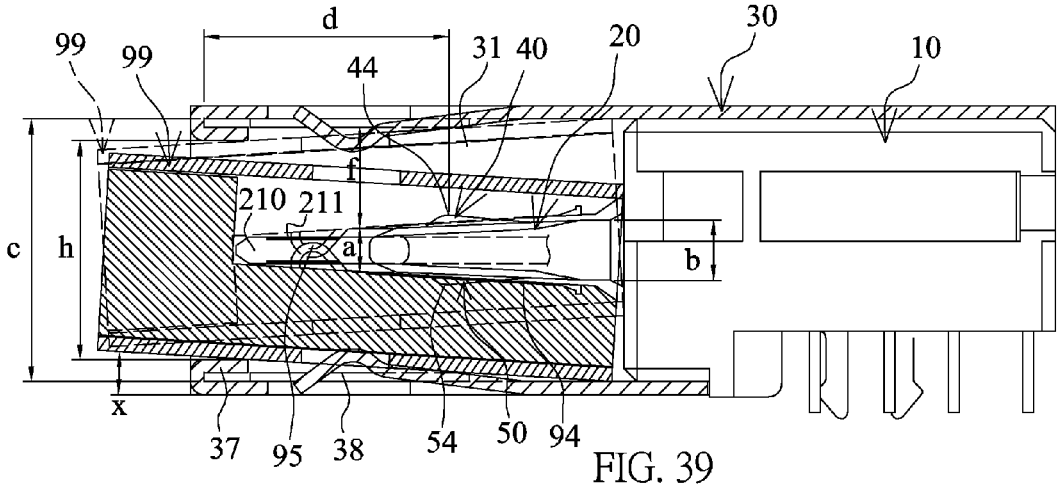
FIG. 39 is a cross-sectional side view showing a twentieth embodiment of the invention.

As shown in FIG. 39, the twentieth embodiment of the invention is a USB 3.0 socket, which is almost the same as the seventeenth embodiment and the eleventh embodiment. The design dimensions of this embodiment are listed in the following. The thickness "a" of the front end of the tongue is equal to about 1 mm; the thickness "b" of the rear end of the tongue is equal to about 1.6 mm; the height "c" of the connection slot is equal to about 6 mm; and the height of the projection 37 is equal to 0.5 mm. So, the height h of the insert port of the connection slot is equal to 5.0 mm, the horizontal distance "d" from the insert end 35 of the positioning plane of the connection slot 31 to the first connection point 44 of the first terminal 40 is equal to about 5.6 mm, and the heights "f" of the spaces beside the two surfaces of the tongue are equal to about 2.5 mm to 2.2 mm. At this time, the positioning included angle "x" between the USB 3.0 male plug 99 and the connection slot 31 is equal to about 3.5 degrees. The solid line in FIG. 39 represents that the USB 3.0 male plug 99 is normally inserted, tilts downwards and is then slantingly positioned, while the dashed line represents that the USB 3.0 male plug 99 is reversely inserted, tilts upwards and is then slantingly positioned.

Figure 40:
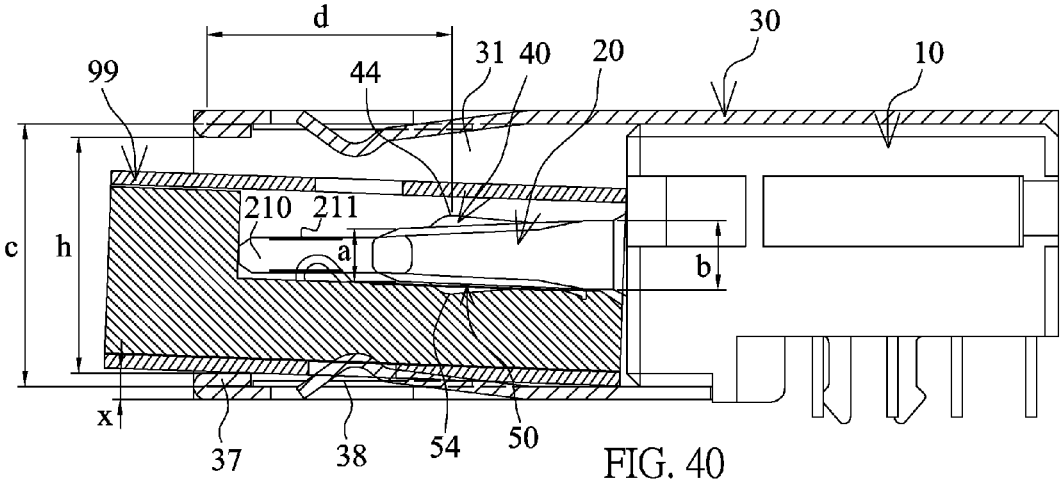
FIG. 40 is a cross-sectional side view showing a 21st embodiment of the invention.

As shown in FIG. 40, the 21$^{st}$ embodiment of the invention is almost the same as the twentieth embodiment except that the thickness "b" of the front end of the tongue 20 of this embodiment is increased to 1.2 mm, the height of the projection 37 is equal to 0.3 mm, and the height h of the insert port is equal to 5.4 mm. At this time, the positioning included angle "x" between the USB 3.0 male plug 99 and the connection slot 31 is equal to about 2.05 degrees.

Figure 41:
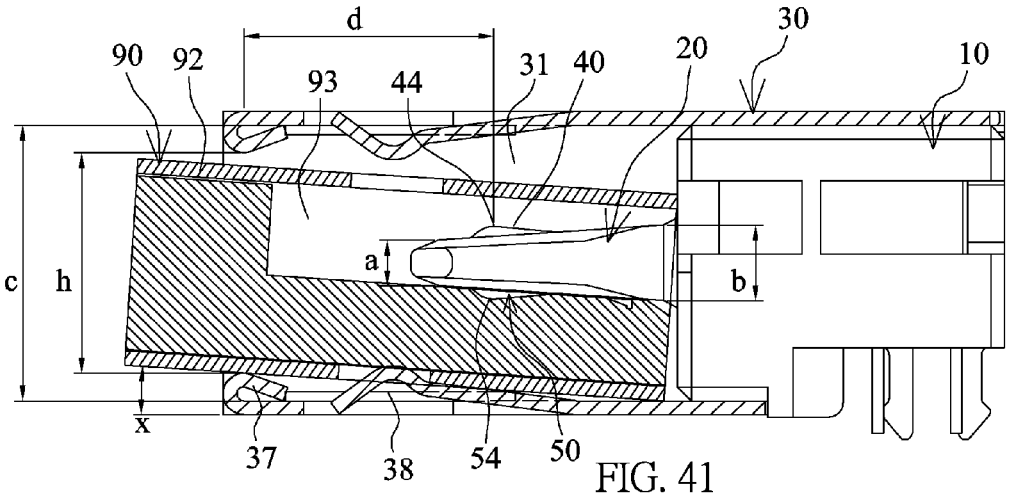
FIG. 41 is a cross-sectional side view showing a 22nd embodiment of the invention.

As shown in FIG. 41, the 22$^{nd}$ embodiment of the invention is a USB 2.0 socket, which is almost the same as the seventeenth embodiment except that the height of the projection 37 of this embodiment is increased to 0.6 mm, and the height h of the insert port is decreased to 4.8 mm. At this time, the positioning included angle "x" between the USB 2.0 male plug 90 and the connection slot 31 is equal to about 4.3 degrees.

Figure 42:
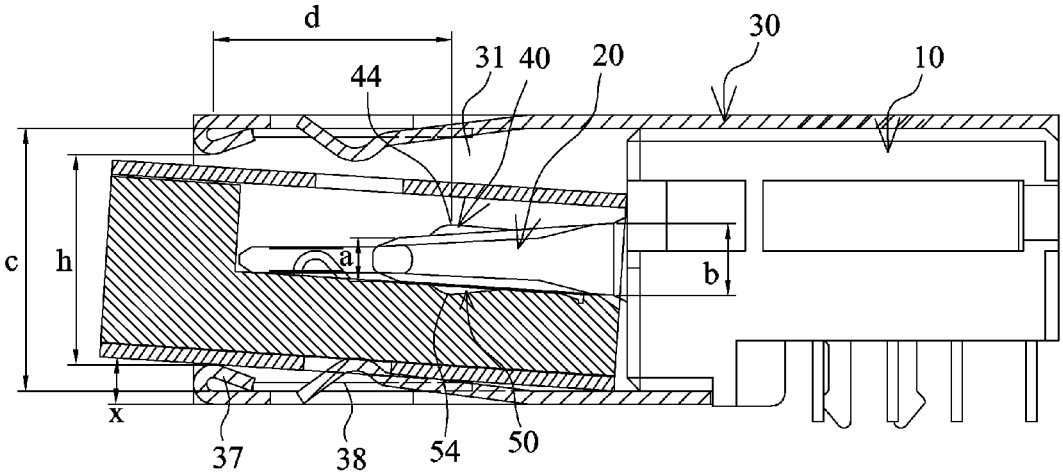
FIG. 42 is a cross-sectional side view showing a 23rd embodiment of the invention.

As shown in FIG. 42, the 23$^{rd}$ embodiment of the invention is almost the same as the 22$^{nd}$ embodiment, wherein the associated dimensions of the two embodiments are the same except that this embodiment is a USB 3.0 socket.

As shown in FIGS. 43 and 44, the 24$^{th}$ embodiment of the invention is almost the same as the seventeenth embodiment except that the top surface and the bottom surface of the front section of the connection slot 31 of this embodiment are respectively prodded to form two projecting strips. The highest point of the front end of the projecting strip is the projection 37. The projecting strip extends backwards to form the rib 38, and the projecting level of the rib 38 is gradually decreased in a backward direction.

As shown in FIGS. 45 and 46, the 25$^{th}$ embodiment of the invention is almost the same as the seventeenth embodiment except that the projections 37 of this embodiment are two projecting points prodded from the top surface and the bottom surface of the front end of the connection slot 31.

According to the structure of the invention, it is possible to ensure that the metal housing of the male plug does not touch the first connection point of the first terminal when the plug is bidirectionally inserted and connected to the socket. The wobble gap between the inserted male plug and the socket can be decreased, and the male plug can be stably positioned. In addition, the gap for isolating the male plug from the first connection point is possibly enlarged to obtain the maximum safety coefficient for the inserted male plug, and the electrical connection function is ensured to be stable and reliable.

As mentioned hereinabove, the gap between the male plug and the first connection point is enlarged so that the male plug may be inserted and removed with the maximum product safety coefficient. The enlarged gap can make the male plug, the first connection point of the first terminal, the metal housing and the tongue have the larger dimensional tolerance, so that the product abnormality caused by the dimension abnormality can be reduced, the possibility caused by the product abnormality can be reduced, and the yield can be significantly enhanced. Although many efforts have been done to increase the product safety coefficient, it is impossible to completely prevent the abnormal operation when the dimension abnormality is caused or the male plug is improperly operated to cause the male plug and the first connection point of the first terminal to have the abnormal condition. Thus, when the male plug and the first connection point of the first terminal are short circuited, a built-in safety protection circuit may be disposed on the circuit board or the plug. The safety protection circuit includes power and ground safety protection circuits, dedicated protection semiconductor chips, fuses, overcurrent protection elements, electrical elements with the rectifier functions, capacitors, software, delay circuit designs, other electrical elements or other operation means capable of preventing the short-circuited condition. With the safety protection circuit, the bidirectional electrical connector cannot damage the electric property even if the plug is abnormally plugged and removed so that the male plug and the first connection point of the first terminal, which are short circuited instantaneously or for a long time, can be protected by the safety protection circuit. Thus, when the male plug touches the first connection point of the first terminal, the short-circuited condition cannot occur. Even if the short-circuited condition is caused, no damage is caused.

In the bidirectional electrical connector having the short-circuit proof mechanism of the invention in conjunction with the general electronic circuit protection, the dual short-circuit proof objects can be achieved so that the product becomes safer and more reliable.

Figure 47:
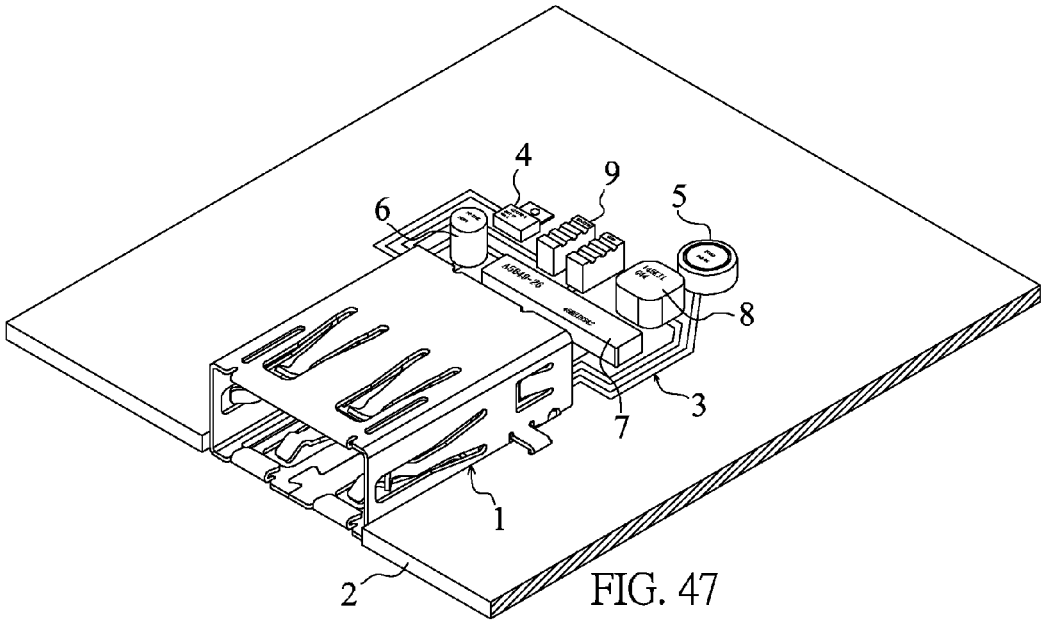
FIG. 47 is a pictorial view showing a 26th embodiment of the invention.

As shown in FIG. 47, the 26$^{th}$ embodiment of the invention includes a bidirectional electrical connector 1, a circuit board 2 and a safety protection circuit 3.

The bidirectional electrical connector 1 is almost the same as the seventeenth embodiment of FIG. 33 and can be bidirectionally electrically connected to the USB 2.0 male plug. The bidirectional electrical connector 1 is bonded to the circuit board 2.

The safety protection circuit 3 includes a power and ground circuit safety protection device 4, a dedicated protection semiconductor chip 5, a fuse 6, an over-current protection element 7, an electrical element 8 with the rectifier function, and another electrical element 9, which are disposed on the circuit board 2. The safety protection circuit 3 is electrically connected to the bidirectional electrical connector 1.

With the above-mentioned structure, when the USB 2.0 male plug is inserted into or removed from the bidirectional electrical connector abnormally so that the metal housing of the USB 2.0 male plug and the first connection point of the first terminal touches each other, the safety protection device 3 prevents the short-circuited condition from occurring or prevents the electrical damage from being caused even if the short-circuited condition occurs.

Figure 48:
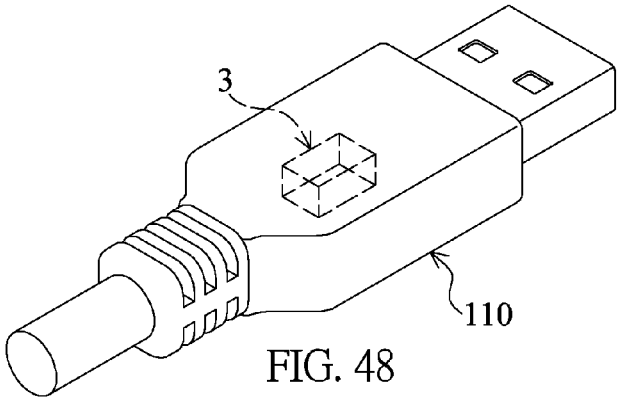
FIG. 48 is a pictorial view showing a 27th embodiment of the invention.

As shown in FIG. 48, the 27$^{th}$ embodiment of the invention is a male plug 110 with a built-in safety protection circuit 3, which may be the same as that of FIG. 47. Thus, when the USB 2.0 male plug 110 is inserted into or removed from the bidirectional electrical connector abnormally so that the metal housing of the USB 2.0 male plug 110 and the first connection point of the first terminal touches each other, the safety protection device 3 prevents the short-circuited condition from occurring or prevents the electrical damage from being caused even if the short-circuited condition occurs.

Figure 49:
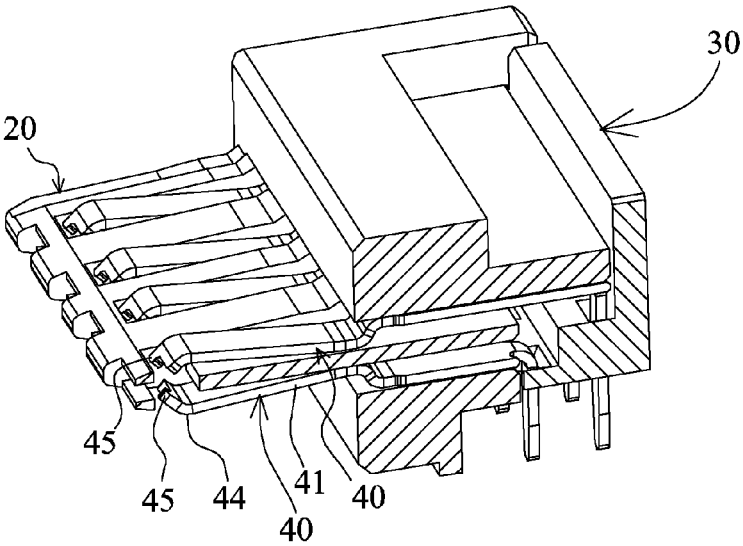
FIG. 49 is a pictorial view showing a 28th embodiment of the invention.

As shown in FIG. 49, the 28$^{th}$ embodiment of the invention is almost the same as the ninth embodiment, wherein a front end of the first connection point 44 of the elastic arm 41 of the first terminal 40 of this embodiment is formed with a guiding inclined surface 45 having a narrower plate surface, the first connection points 44 of the two rows of first terminals correspond to each other in a vertical direction, and the guiding inclined surfaces 45 of the elastic arms 41 of the two rows of first terminals 40 are staggered in a left to right direction and suspended without touching the tongue 20. In addition, the metal casing of this embodiment may be similar to that of the seventeenth embodiment.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. An electrical connector, into which a male plug may be bidirectionally inserted and connected, the male plug having an insulation base and a metal housing covering the insulation base, a connection space being formed in the metal housing, the electrical connector comprising:

a plastic base;

a tongue projectingly disposed at a front end of the plastic base;

a connection slot disposed at the front end of the plastic base and covering the tongue, wherein when the male plug is inserted and positioned within the connection slot, the tongue is inserted into the connection space; and two rows of first connection points respectively exposed from two surfaces of the tongue, each of the first connection points being electrically connected to a pin extending out of the plastic base;

wherein spaces of the connection slot beside the two surfaces of the tongue allow the male plug to be bidirectionally inserted and positioned, and when the male plug is positioned within the connection slot, the metal housing of the male plug does not touch the first connection point; and when the male plug is inserted into the connection slot and reaches a horizontal position of the first connection point with a maximum inclined angle between the male plug and the connection slot, the metal housing of the male plug does not touch the first connection point, wherein at the maximum inclined angle, the male plug is in direct contact with an inner top wall and an inner bottom wall, which define the connection slot, and the tongue is partially accommodated within the connection space, wherein the two rows of first connection points project beyond the two surfaces of the tongue when the male plug is not inserted, the tongue has one end fixed to the plastic base and the other end being a free end, and the tongue is integrally located at the same position before and after the male plug is inserted and positioned within the connection slot and electrically connected to the electrical connector.

2. The connector according to claim 1, wherein the connection slot is formed by a metal casing positioned at the front end of the plastic base.

3. The connector according to claim 1, wherein a front section of the tongue has a thickness smaller than 1.7 mm.

4. The connector according to claim 1, wherein the two rows of first connection points and the pins are formed on two rows of first terminals, each of the first terminals has an elastic arm, a fixing portion and the pin, the fixing portion is positioned within the plastic base, the elastic arm extends toward the connection slot and is formed with the first connection point projecting beyond one of the surfaces of the tongue, and the first connection points of the two rows of first terminals respectively project beyond the two surfaces of the tongue.

5. The connector according to claim 1, wherein a thickness of a front section of the tongue is smaller than 1.6 mm, a horizontal distance from an insert end of a positioning plane of the connection slot to the first connection point is greater than 3.55 mm, a height of the connection slot is smaller than 6.4 mm and greater than 5.25 mm, and when the male plug is inserted into the connection slot and reaches the horizontal position of the first connection point with the maximum inclined angle between the male plug and the connection slot, an included angle between the male plug and the connection slot is smaller than 25 degrees, and the metal housing of the male plug does not touch the first connection point.

6. The connector according to claim 1, wherein a horizontal distance from an insert end of a positioning plane of the connection slot to the first connection point is greater than 5.2 mm, a height of the connection slot is smaller than 6.1 mm and greater than 5.25 mm, a thickness of a front section of the tongue is smaller than 1.4 mm, and when the male plug is inserted into the connection slot and reaches the horizontal position of the first connection point with the maximum inclined angle between the male plug and the connection slot, an included angle between the male plug and the connection slot is smaller than 17 degrees, and a gap between the metal housing of the male plug and the first connection point is greater than 0.15 mm.

7. The connector according to claim 1, wherein a horizontal distance from an insert end of a positioning plane of the connection slot to the first connection point is greater than 5.7 mm, a height of the connection slot is smaller than 5.9 mm and greater than 5.25 mm, a thickness of a front section of the tongue is smaller than 1.25 mm, and when the male plug is inserted into the connection slot and reaches the horizontal position of the first connection point with the maximum inclined angle between the male plug and the connection slot, an included angle between the male plug and the connection slot is smaller than 14.2 degrees, and a gap between the metal housing of the male plug and the first connection point is greater than 0.25 mm.

8. The connector according to claim 1, wherein the tongue and the plastic base are integrally formed and a rear end of the tongue is thicker than a front end of the tongue.

9. The connector according to claim 8, wherein the tongue is tapered from the rear end to the front end.

10. The connector according to claim 8, wherein a thickness of the front end of the tongue is smaller than 1.35 mm, and a thickness of the rear end of the tongue ranges from 1.4 mm to 1.8 mm.

11. The connector according to claim 1, wherein a top surface and a bottom surface of a rear section of a connection slot of the male plug are formed with concave surfaces, so that a height of the rear section of the connection slot is greater than a height of an insert port.

12. The connector according to claim 1, wherein an included angle between the male plug and a bottom surface of the connection slot is greater than 1 degree.

13. The connector according to claim 1, wherein when the male plug is inserted into the connection slot and reaches the horizontal position of the first connection point with the maximum inclined angle between the male plug and the connection slot, a gap between the metal housing of the male plug and the first connection point is greater than 0.05 mm.

14. The connector according to claim 1, wherein when the male plug is inserted into the connection slot and reaches the horizontal position of the first connection point with the maximum inclined angle between the male plug and the connection slot, a gap between the metal housing of the male plug and the first connection point is greater than 0.15 mm.

15. The connector according to claim 1, wherein each of the two surfaces of the tongue is formed with one row of second connection points, each of the second connection points is electrically connected to a pin extending out of the plastic base, and the one row of second connection points is disposed in front of the one row of first connection points.

16. The connector according to claim 15, wherein the two rows of second connection points and the two rows of pins are formed on two rows of second terminals, and the two rows of second terminals are positioned within the plastic base.

17. The connector according to claim 15, wherein the two rows of second connection points are formed on front sections of two surfaces of a circuit board, the plastic base is integrally formed with a frontwardly projecting tab, which is a rear section of the tongue, the circuit board passes through the tab and is positioned, and the front section of the circuit board projects in front of the tab to form a front section of the tongue.

18. The connector according to claim 15 being a USB 3.0 socket, wherein each of the two rows of first connection points has four elastically movable connection points, and each of the two rows of second connection points has five connection points, which cannot be elastically moved.

19. The connector according to claim 15, wherein a horizontal distance from an insert end of a positioning plane of the connection slot to the first connection point is greater than 4.15 mm, and a height of the connection slot is smaller than 6.4 mm and greater than 5.7 mm.

20. The connector according to claim 1, wherein the tongue is an insulating flat plate, and the tongue is assembled with and positioned at the plastic base.

21. The connector according to claim 1, wherein when the male plug is bidirectionally inserted into the connection slot, a half height of the male plug is fit and positioned with the space of the connection slot beside one of the surfaces of the tongue.

22. The connector according to claim 4, wherein a front end of the first connection point of the elastic arm of each of the two rows of first terminals is formed with a guiding inclined surface having a narrower plate surface, the first connection points of the two rows of first terminals correspond to each other in a vertical direction, and the guiding inclined surfaces of the two rows of first terminals are staggered in a left to right direction.

23. An electrical connector, into which a male plug may be bidirectionally inserted and connected, the male plug having an insulation base and a metal housing covering the insulation base, a connection space being formed in the metal housing, the electrical connector comprising:

a plastic base;

a tongue projectingly disposed at a front end of the plastic base;

a connection slot disposed at the front end of the plastic base and covering the tongue, wherein when the male plug is inserted and positioned within the connection slot, the tongue is inserted into the connection space; and two rows of first connection points respectively exposed from two surfaces of the tongue, each of the first connection points being electrically connected to a pin extending out of the plastic base;

wherein spaces of the connection slot beside the two surfaces of the tongue allow the male plug to be bidirectionally inserted and positioned, and the connection slot allows the male plug, which is bidirectionally inserted, to be slantingly positioned so that connection points of the male plug in the connection space are electrically connected to the one row of the first connection points, wherein the connection slot comprises a top portion and a bottom portion opposite to the top portion, a direction from the top portion to the bottom portion is defined as a vertical direction, each of the top portion and the bottom portion has a front section close to an insert port of the connection slot, and a rear section away from the insert port of the connection slot, a shortest distance from the front section of the top portion to the front section of the bottom portion in the vertical direction is smaller than a shortest distance from the rear section of the top portion to the rear section of the bottom portion in the vertical direction, so that when the male plug is bidirectionally inserted and slantingly positioned in the connection slot, the male plug is in direct contact with the front section of the top portion and the rear section of the top portion, or the male plug is in direct contact with the front section of the bottom portion and the rear section of the bottom portion.

24. The connector according to claim 23, wherein when the male plug is positioned within the connection slot, the metal housing of the male plug does not touch the first connection point.

25. The connector according to claim 23, wherein when the male plug is inserted into the connection slot and reaches a horizontal position of the first connection point with a maximum inclined angle between the male plug and the connection slot, the metal housing of the male plug does not touch the first connection point.

26. The connector according to claim 23, wherein a front section of the tongue has a thickness smaller than 1.7 mm.

27. The connector according to claim 23, wherein the two rows of first connection points and the pins are formed on two rows of first terminals, each of the first terminals has an elastic arm, a fixing portion and the pin, the fixing portion is positioned within the plastic base, the elastic arm extends toward the connection slot and is formed with the first connection point projecting beyond one of the surfaces of the tongue, and the first connection points of the two rows of first terminals respectively project beyond the two surfaces of the tongue.

28. The connector according to claim 27 being a USB 2.0 socket, wherein each of the two rows of first terminals has four first terminals, the male plug is a USB 2.0 male plug, and heights of the spaces beside the two surfaces of the tongue range from 2.2mm to 2.6 mm.

29. The connector according to claim 23, wherein the tongue and the plastic base are integrally formed and a rear end of the tongue is thicker than a front end of the tongue.

30. The connector according to claim 29, wherein the tongue is tapered from the rear end to the front end.

31. The connector according to claim 29, wherein a thickness of the front end of the tongue is smaller than 1.35 mm, and a thickness of the rear end of the tongue ranges from 1.4 mm to 1.8 mm.

32. The connector according to claim 23, wherein the front section of the top portion and the front section of the bottom portion of the connection slot are formed with projections projecting toward a center of the connection slot, a vertical distance from the projection on the top surface to the projection on the bottom surface is equal to a height of the insert port, so that the height of the insert port is smaller than a height of the connection slot inside the insert port from the rear section of the top portion to the rear section of the bottom portion, and a maximum inclined angle for insertion of the male plug is decreased to prevent a short circuit and decrease an insert gap to prevent wobble.

33. The connector according to claim 32, wherein the connection slot is formed by a metal casing, the metal casing is positioned at the front end of the plastic base, and the projection is formed by reversely bending a front end of the metal casing toward inside of the connection slot.

34. The connector according to claim 32, wherein the projection has a height ranging from 0.2 mm to 0.8 mm.

35. The connector according to claim 23, wherein an included angle between the male plug and a bottom surface of the connection slot is greater than 1 degree.

36. The connector according to claim 23, wherein a horizontal distance from an insert end of a positioning plane of the connection slot to the first connection point is greater than 3.55 mm, the height of the connection slot is smaller than 6.4 mm and greater than 5.7 mm, and the height of the insert port of the connection slot is smaller than 5.6 mm and greater than 4.6 mm.

37. The connector according to claim 23, wherein a horizontal distance from an insert end of a positioning plane of the connection slot to the first connection point is greater than 5 mm, the height of the connection slot is smaller than 6.2 mm and greater than 5.7 mm, the height of the insert port of the connection slot is smaller than 5.4 mm and greater than 4.6 mm, a thickness of a front section of the tongue is smaller than 1.3 mm, and when the male plug is inserted into the connection slot and reaches a horizontal position of the first connection point with a maximum inclined angle between the male plug and the connection slot, an included angle between the male plug and the connection slot is smaller than 13 degrees, and a gap between the metal housing of the male plug and the first connection point is greater than 0.25 mm.

38. The connector according to claim 23, wherein a height of the insert port of the connection slot is smaller than 5.1 mm.

39. The connector according to claim 23, wherein each of a top surface and a bottom surface of a front section of the connection slot is formed with at least one rib extending from front to rear.

* * * * *